US005236807A

United States Patent [19]

Inoue et al.

[11] Patent Number: 5,236,807

[45] Date of Patent: Aug. 17, 1993

[54] IMAGE FORMATION METHOD AND SILVER HALIDE PHOTOGRAPHIC MATERIAL THEREFOR

[75] Inventors: Nobuaki Inoue; Tetsuo Yoshida; Shuzo Suga; Hiroyuki Goto, all of Kanagawa, Japan

[73] Assignee: Fuji Photo Film Co., Ltd., Kanagawa, Japan

[21] Appl. No.: 860,208

[22] Filed: Mar. 27, 1992

Related U.S. Application Data

[63] Continuation of Ser. No. 498,126, Mar. 23, 1990, abandoned.

[30] Foreign Application Priority Data

| | | | |
|---|---|---|---|
| Mar. 24, 1989 | [JP] | Japan | 1-73361 |
| Mar. 27, 1989 | [JP] | Japan | 1-74746 |
| May 9, 1989 | [JP] | Japan | 1-115359 |
| May 25, 1989 | [JP] | Japan | 1-131762 |

[51] Int. Cl.[5] ..... G03C 1/34

[52] U.S. Cl. ..... 430/264; 430/512; 430/583; 430/591; 430/606

[58] Field of Search ..... 430/264, 512, 606, 949, 430/583, 591

[56] References Cited

U.S. PATENT DOCUMENTS

| | | | |
|---|---|---|---|
| 4,803,149 | 2/1989 | Takahashi et al. | 430/264 |
| 4,830,950 | 5/1989 | Kuwabara et al. | 430/264 |
| 4,847,180 | 7/1989 | Miyata et al. | 430/264 |
| 4,908,293 | 3/1990 | Katoh et al. | 430/264 |

*Primary Examiner*—Janet C. Baxter

*Attorney, Agent, or Firm*—Sughrue, Mion, Zinn, Macpeak & Seas

[57] ABSTRACT

A method for forming an image is disclosed, comprising imagewise exposing a negatively working silver halide photographic material comprising a support having thereon at least one silver halide emulsion layer with light having a wavelength of from 460 to 600 nm and containing substantially no light having a wavelength of 360 nm or less, said emulsion layer containing at least one sensitizing dye having an absorption maximum ($\lambda_{max}$) at a wavelength of form 450 nm to 580 nm, and said emulsion layer or other hydrophilic colloidal layer containing at least one hydrazine derivative. The method provides an image having excellent image quality either in enlargement or reduction work without causing reduction in sensitivity or inducing black pepper.

9 Claims, 1 Drawing Sheet

IMAGE FORMATION METHOD AND SILVER HALIDE PHOTOGRAPHIC MATERIAL THEREFOR

This is a continuation of application Ser. No. 07/498,126, filed Mar. 23, 1990, now abandoned.

FIELD OF THE INVENTION

This invention relates to a method for forming an image with good reproducibility which is useful in the field of photomechanical process and to a silver halide photographic material to be used in the method.

BACKGROUND OF THE INVENTION

In the field of photomechanical process, there are demands for satisfactory image reproducibility, stability of processing solutions, and simplification of replenishment in order to cope with the recent diversity and complexity of printed materials.

In particular, originals in line work are comprised of photo-composed letters, hand-written letters, illustrations, dot prints, etc. and thus contain images having different densities or line widths. It has been therefore keenly demanded to develop a process camera, a photographic light-sensitive material or an image formation system which enables us to reproduce the original with good reproducibility. In the photomechanical process of catalogues or large posters, on the other hand, enlargement or reduction of a dot print is widely conducted. When a dot print is enlarged in plate making, the line number becomes small and the dots are blurred. When a dot print is reduced, the line number/inch becomes larger and the dots become finer than the original. Accordingly, an image formation system having a broader latitude has been demanded for maintaining reproducibility of halftone gradation.

A halogen lamp or a xenon lamp is employed as a light source of a process camera. In order to obtain photographic sensitivity to these light sources, photographic materials are usually subjected to orthochromatic sensitization. However, it turned out that orthochromatic materials are more susceptible to influences of chromatic aberration of a lens and thus liable to image quality deterioration. The deterioration is conspicuous in using a xenon lamp as a light source.

Known systems meeting the demand for a broad latitude include a method comprising processing a lith silver halide light-sensitive material comprising silver chlorobromide (containing at least 50% of silver chloride) with a hydroquinone developer having an extremely low effective sulfite ion concentration (usually 0.1 mol/l or less) to thereby obtain a line or dot image having high contrast and high density in which image areas and non-image areas are clearly distinguished. According to this method, however, development is extremely unstable against air oxidation due to the low sulfite concentration of the developer. Hence, various efforts and devices are required to stabilize the developing activity and, also, under the present situation, the processing speed is considerably low to reduce working efficiency.

It has thus been demanded to establish an image formation system which eliminates the image formation instability associated with the above-described lith development system and provides a ultrahigh contrast image by using a processing solution having satisfactory preservation stability. In this connection, it has been proposed to develop a surface latent image type silver halide photographic material containing a specific acylhydrazine compound with a developing solution having a pH between 11.0 and 12.3 and containing at least 0.15 mol of a sulfite preservative and thereby exhibiting satisfactory preservation stability to form a ultrahigh contrast negative image having a gamma exceeding 10, as disclosed in U.S. Pat. Nos. 4,166,742, 4,168,977, 4,221,857, 4,224,401, 4,243,739, 4,272,606, and 4,311,781. This new image formation system is characterized in that silver iodobromide and silver chloroiodobromide as well as silver chlorobromide are applicable thereto, whereas the conventional ultrahigh contrast image formation systems are only applicable to photographic materials comprising silver chlorobromide of high silver chloride content.

While the above-described image formation system exhibits excellent performance in dot quality, stability of processing, and rapidness of processing, there are disadvantages, such as poor reproducibility of line originals, poor reproducibility in reduction or enlargement work, and large dependence on light source, and improvements on these points have been demanded.

In the above-described image formation system, exposure through a filter has been adopted for various purposes as disclosed, e.g., in JP-A-62-210458, JP-A-63-104046, JP-A-63-103235, JP-A-63-95438, JP-A-63-95435, JP-A-63-95437, JP-A-63-306436, and JP-A-64-55549. However, application of any of these methods is limited to light-sensitive materials for bright room processing containing no orthochromatic sensitizing dyes.

Image formation systems of using hydrazine derivatives have been proposed to obtain a high contrast image while using a stable developer as disclosed in U.S. Pat. Nos. 4,224,401, 4,168,977, 4,166,742, 4,311,781, 4,272,606, 4,211,857, and 4,243,739. According to these systems, ultrahigh contrast and high sensitivity can be obtained. Further, since use of a developer containing a sulfite in a high concentration is permissive, stability of the developer against air oxidation can be greatly improved over lith developers. Nevertheless, it has turned out that the systems using hydrazine derivatives tend to cause a phenomenon called black pepper.

The terminology "black pepper" as used herein means black spots appearing in non-image areas (for example, between dots). The black pepper phenomenon conspicuously takes place when a sulfite ion concentration commonly employed as a preservative is reduced or the pH of the developer increases due to fatigue of a developer with time and causes impairment of image quality.

Use of certain kinds of shorter wavelength sensitizing dyes to eliminate black pepper is disclosed in JP-A-62-237445, JP-A-62-280733, JP-A-01-61743, JP-A-01-61744, JP-A-01-92738, and JP-A-01-217339.

SUMMARY OF THE INVENTION

One object of this invention is to provide a method for forming an image which, while retaining photographic sensitivity, is less causative of black pepper, less dependent on a light source, and excellent in line image quality, such as suitability to enlargement or reduction work.

Another object of this invention is to provide a negatively working silver halide photographic material which is used in the above-described image formation method.

A further object of this invention is to provide a method for forming an image which has satisfactory reproducibility in the field of photomechanical process and, particularly, plate making with a process camera.

A still further object of this invention is to provide a silver halide photographic material which is used for such image formation method.

The above objects of this invention are accomplished by a method for forming an image which comprises imagewise exposing a negatively working silver halide photographic material comprising a support having thereon at least one silver halide emulsion layer with light having a wavelength of from 460 to 600 nm and containing no substantial light having a wavelength of 360 nm or less, said emulsion layer containing at least one sensitizing dye having an absorption maximum ($\lambda_{max}$) between 450 nm and 580 nm, and said emulsion layer or other hydrophilic colloidal layer containing at least one hydrazine derivative.

DETAILED DESCRIPTION OF THE INVENTION

Figure 1:
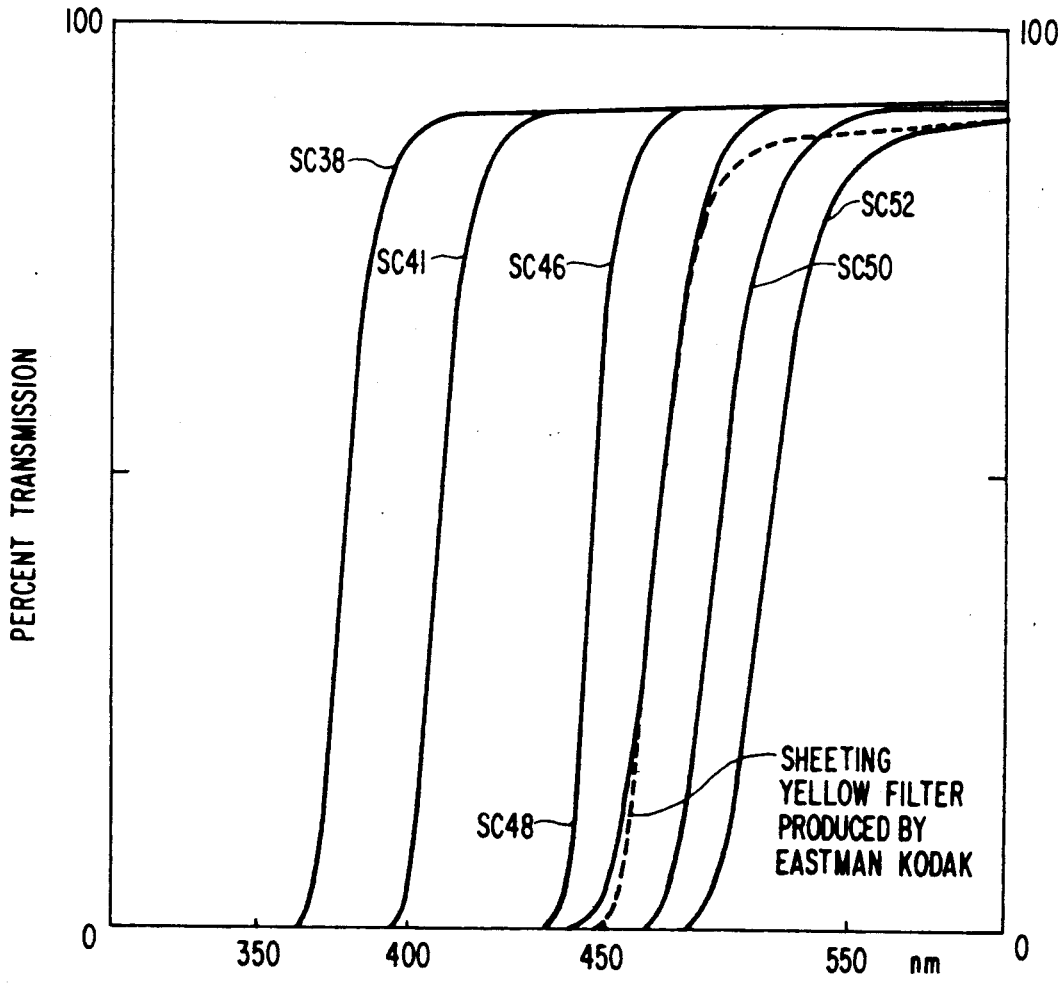
FIG. 1 shows spectral absorption characteristics of filters used in Examples 1 to 3, with percent transmission as ordinate and wavelength as abscissa.

The image formed by the method of this invention is characterized by its ultrahigh contrast having a gradient ($\lambda$) of 9 or higher, and particularly 12 or higher. The terminology "$\lambda$ (gamma)" as used herein is defined by equation:

$$\gamma = \frac{3.0 - 0.3}{\text{log(exposure amount providing density of 3.0)} - \text{log(exposure amount providing density of 0.3)}}$$

A system for achieving a gradient ($\lambda$) of 9 or higher according to the present invention consists in processing of a surface latent image type silver halide photographic material containing a hydrazine derivative (e.g., specific acylhydrazine compounds as described, e.g., in U.S. Pat. Nos. 4,166,742, 4,168,977, 4,221,857, 4,224,401, 4,243,739, 4,272,606, and 4,311,781) with a developer having a pH between 11.0 and 12.3 and containing a sulfite preservative in a concentration of not less than 0.15 mol/l.

Hydrazine derivatives which can be used in the present invention are represented by formula (I):

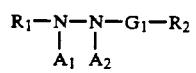

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group; $R_2$ represents a hydrogen atom, an alkyl group, an aryl group, an alkoxyl group, an aryloxy group, an amino group, a carbamoyl group, or an oxycarbonyl group; $G_1$ represents a carbonyl group, a sulfonyl group, a sulfoxy group, a

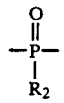

$$-\overset{\overset{O}{\|}}{\underset{\underset{R_2}{|}}{P}}-$$

group (wherein $R_2$ is as definad above), or an iminomethylene group; $A_1$ and $A_2$ each represents a hydrogen atom, or one of $A_1$ and $A_2$ represents a hydrogen atom, the other representing a substituted or unsubstituted alkylsulfonyl group, a substituted or unsubstituted arylsulfonyl group, or a substituted or unsubstituted acyl group.

In formula (I), the aliphatic group as represented by $R_1$ preferably includes those containing from 1 to 30 carbon atoms, and more preferably a straight chain, branched or cyclic alkyl group having from 1 to 20 carbon atoms. The branched alkyl group may be cyclized to form a saturated heterocyclic ring containing at least one hetero atom. Further, the alkyl group may be substituted with an aryl group, an alkoxyl group, a sulfoxy group, a sulfonamido group, a carbonamido group, etc.

The aromatic group as represented by $R_1$ is a monocyclic or bicyclic aryl group or an unsaturated heterocyclic group. The unsaturated heterocyclic group may be condensed with a monocyclic or bicyclic aryl group to form a heteroaryl group. Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, with those containing a benzene ring being particularly preferred.

$R_1$ preferably represents an aryl group.

The aryl group or unsaturated heterocyclic group as $R_1$ may have a substituent typically including a straight chain, branched or cyclic alkyl group (preferably having from 1 to 20 carbon atoms), an aralkyl group (preferably a monocyclic or bicyclic group having from 1 to 3 carbon atoms in the alkyl moiety thereof), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms).

The alkyl group as represented by $R_2$ in formula (I) preferably contains from 1 to 4 carbon atoms and may have a substituent, e.g., a halogen atom, a cyano group, a carboxyl group, a sulfo group, an alkoxyl group, and a phenyl group.

The aryl group as represented by $R_2$ preferably includes a monocyclic or bicyclic aryl group, such as those containing a benzene ring. The aryl group may have a substituent, e.g., a halogen atom, an alkyl group, a cyano group, a carboxyl group, and a sulfo group.

The alkoxyl group as represented by $R_2$ preferably contains from 1 to 8 carbon atoms and may be substituted with a halogen atom, an aryl group, etc.

The aryloxy group as represented by $R_2$ is preferably monocyclic and may be substituted with a halogen atom, etc.

The amino group as represented by $R_2$ may be substituted with an alkyl group, a halogen atom, a cyano group, a nitro group, a carboxyl group, etc. Preferably included in the amino group are an unsubstituted amino group, an alkylamino group having from 1 to 10 carbon atoms, and an arylamino group.

The carbamoyl group as represented by $R_2$ may be substituted with an alkyl group, a halogen atom, a cyano group, a carboxyl group, etc. Preferably included in the carbamoyl group are an unsubstituted carbamoyl group, an alkylcarbamoyl group having from 1 to 10 carbon atoms, and an arylcarbamoyl group.

The oxycarbonyl group as represented by $R_2$ preferably includes an alkoxycarbonyl group having from 1 to 10 carbon atoms and an aryloxycarbonyl group. The hydroxycarbonyl group may be substituted with an alkyl group, a halogen atom, a cyano group, a nitro group, etc.

Where $G_1$ is a carbonyl group, $R_2$ preferably represents a hydrogen atom, an alkyl group (e.g., methyl, trifluoromethyl, 3-hydroxypropyl, and 3-methanesulfonamidopropyl), an aralkyl group (e.g., o-hydroxybenzyl), or an aryl group (e.g., phenyl, 3,5-dichlorophenyl, o-methanesulfonamidophenyl, and 4-methanesulfonylphenyl), and more preferably a hydrogen atom.

Where $G_1$ is a sulfonyl group, $R_2$ preferably represents an alkyl group (e.g., methyl), an aralkyl group (e.g., o-hydroxyphenylmethyl), an aryl group (e.g., phenyl), or a substituted amino group (e.g., dimethylamino).

Where $G_1$ is a sulfoxy group, $R_2$ preferably represents a cyanobenzyl group or a methylthiobenzyl group.

Where $G_1$ is

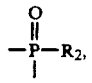

$R_2$ preferably represents a methoxy group, an ethoxy group, a butoxy group, a phenoxy group, or a phenyl group, and more preferably a phenoxy group.

Where $G_1$ is an N-substituted or unsubstituted iminomethylene group, $R_2$ preferably represents a methyl group, an ethyl group, or a substituted or unsubstituted phenyl group.

Substituents applicable to $R_2$ include those enumerated above as the substituents of $R_1$ and, in addition, an acyl group, an acyloxy group, an alkyloxycarbonyl group, an aryloxycarbonyl group, an alkenyl group, an alkynyl group, and a nitro group.

$G_1$ preferably represents a carbonyl group.

$R_2$ may be a group which makes the $G_1$—$R_2$ moiety be split off from the remainder of formula (I) to induce cyclization producing a cyclic structure containing the —$G_1$—$R_2$ moiety. More specifically, such a group is represented by formula (a):

$$-R_3-Z_1 \qquad \text{(a)}$$

wherein $Z_1$ represents a group which nucleophilically attacks $G_1$ to split the $G_1$—$R_3$—$Z_1$ moiety from the remainder; $R_3$ represents a group derived by removing one hydrogen atom from $R_2$; and $R_3$ and $Z_1$ form a cyclic structure together with $G_1$ upon nucleophilic attack of $Z_1$ on $G_1$.

In more detail, when the hydrazine compound of formula (I) undergoes any reaction such as oxidation to produce an intermediate represented by formula $R_1$—N=N—$G_1$—$R_3$—$Z_1$, $Z_1$ easily reacts nucleophilically with $G_1$ to separate $R_1$—N=N from $G_1$. Such a group as $Z_1$ includes a functional group capable of directly reacting with $G_1$, e.g., OH, SH, $NHR_4$ (wherein $R_4$ represents a hydrogen atom, an alkyl group, an aryl group, —$COR_5$, or —$SO_2R_5$, wherein $R_5$ represents a hydrogen atom, an alkyl group, an aryl group, a heterocyclic group, etc.), and —COOH (these functional groups may be temporarily protected so as to release the functional group upon hydrolysis with an alkali, etc.) and a functional group which becomes capable of reacting with $G_1$ on reacting with a nucleophilic agent (e.g., a hydroxide ion and a sulfite ion), such as

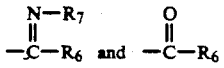

(wherein $R_6$ and $R_7$ each represents a hydrogen atom, an alkyl group, an alkenyl group, an aryl group, or a heterocyclic group).

The ring formed by $G_1$, $R_3$, and $Z_1$ is preferably a 5- or 6-membered ring.

Preferred of the groups represented by formula (a) are those represented by formulae (b) and (c):

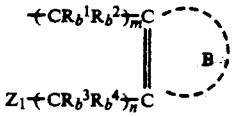

(b)

wherein $Z_1$ is as defined above; $R_b^1$, $R_b^2$, $R_b^3$, and $R_b^4$, which may be the same or different, each represents a hydrogen atom, an alkyl group (preferably having from 1 to 12 carbon atoms), an alkenyl group (preferably having from 2 to 12 carbon atoms), an aryl group (preferably having from 6 to 12 carbon atoms), etc.; B represents an atom group necessary to form a substituted or unsubstituted 5- or 6-membered ring; m and n each represents 0 or 1; and (n+m) is 1 or 2.

In formula (b), the 5- or 6-membered ring formed by B includes cyclohexene, cycloheptene, benzene, naphthalene, pyridine, and quinoline rings.

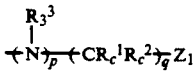

(c)

wherein $Z_1$ is as defined above; $R_c^1$ and $R_c^2$, which may be the same or different, each represents a hydrogen atom, an alkyl group, an alkenyl group, an aryl group, a halogen atom, etc.; $R_c^3$ represents a hydrogen atom, an alkyl group, an alkenyl group, or an aryl group; p represents 0 or 1; g represents an integer of from 1 to 4; $R_c^1$, $R_c^2$, and $R_c^3$ may be taken together to form a ring as long as $Z_1$ is capable of intramolecular nucleophilic attack on $G_1$.

$R_c^1$ and $R_c^2$ each preferably represents a hydrogen atom, a halogen atom, or an alkyl group, and $R_c^3$ preferably represents an alkyl group or an aryl group.

g preferably represents 1 to 3. When g is 1, p represents 1 or 2; when g is 2, p represents 0 or 1; when g is 3, p represents 0 or 1; and when g is 2 or 3, $CR_c^1R_c^2$ moieties may be the same or different.

In formula (I), $A_1$ and $A_2$ each represents a hydrogen atom, an alkylsulfonyl or arylsulfonyl group having not more than 20 carbon atoms (preferably a phenylsulfonyl group or a phenylsulfonyl group which is substituted so that a sum of Hammett's $\sigma$ values may be $-0.5$ or more), an acyl group having not more than 20 carbon atoms [preferably a benzoyl group, a benzoyl group which is substituted so that a sum of Hammett's $\sigma$ values may be $-0.5$ or more, or a straight chain, branched or cyclic and substituted or unsubstituted aliphatic acyl group (the substituent includes a halogen atom, an ether group, a sulfonamido group, a carbonamido group, a hydroxyl group, a carboxyl group, and a sulfo group)].

$A_1$ and $A_2$ each preferably represents a hydrogen atom.

$R_1$ or $R_2$ in formula (I) may contain a ballast group commonly employed in immobile photographic additives such as couplers. A ballast group is a group which contains at least 8 carbon atoms and is relatively inert to photographic characteristics. Suitable ballast groups are selected from an alkyl group, an alkoxyl group, a phenyl group, an alkylphenyl group, a phenoxy group, an alkylphenoxy group, etc.

$R_1$ or $R_2$ may further contain a group which accelerates adsorption to surfaces of silver halide grains (hereinafter referred to as an adsorption accelerating group). Examples of such an adsorption accelerating group are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, including a thiourea group, a heterocyclic thioamido group, a mercapto heterocyclic group, and a triazole group.

specific examples of the hydrazine derivative represented by formula (I) are shown below for illustrative purposes only but not for limitation.

I-1)

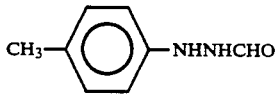

I-2)

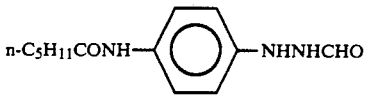

I-3)

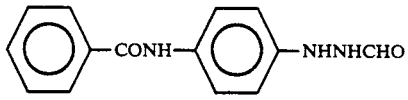

I-4)

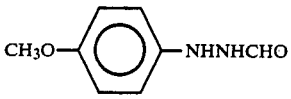

I-5)

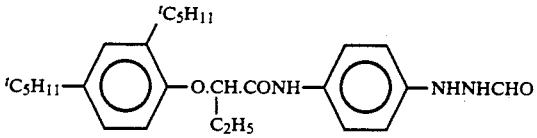

I-6)

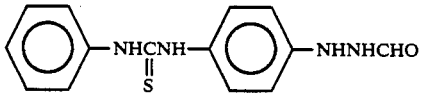

I-7)

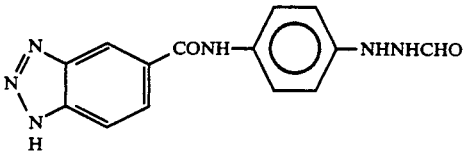

I-8)

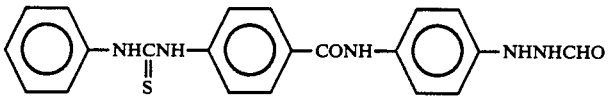

I-9)

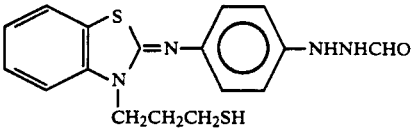

-continued
I-10)
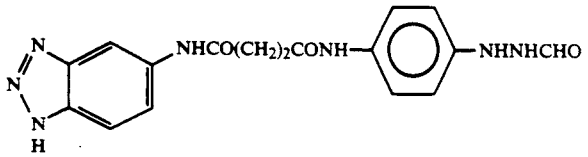
I-11)
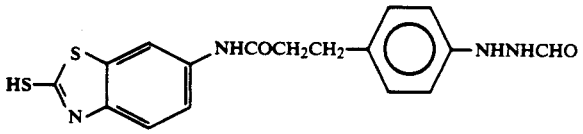
I-12)
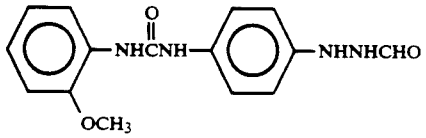
I-13)
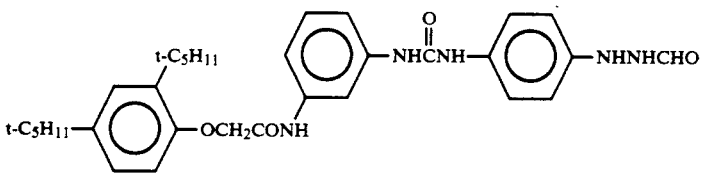
I-14)
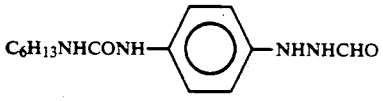
I-15)
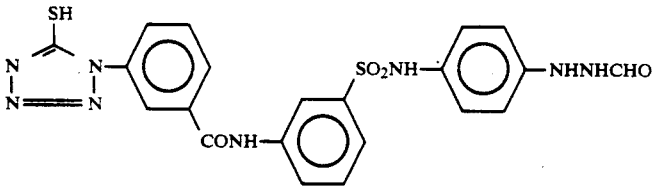
I-16)
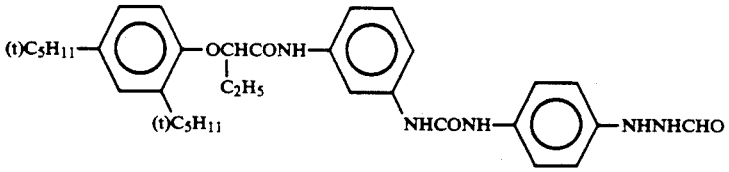
I-17)
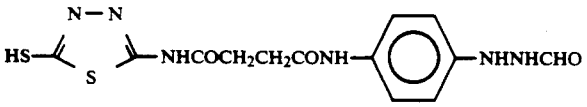
I-18)
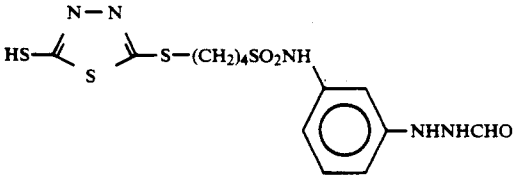

-continued
I-19)
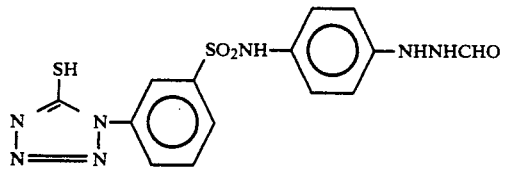
I-20)
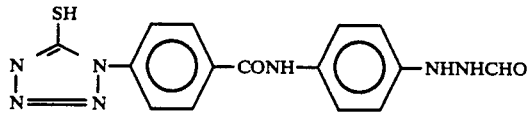
I-21)
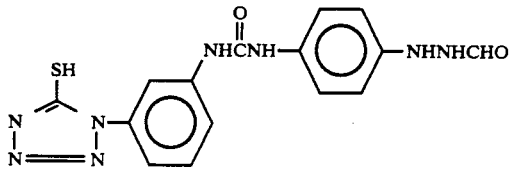
I-22)
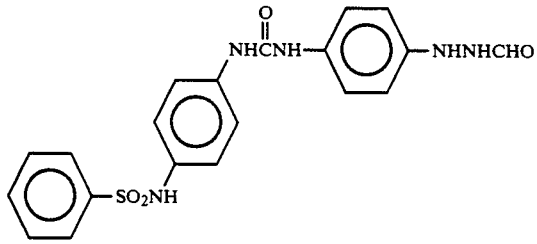
I-23)
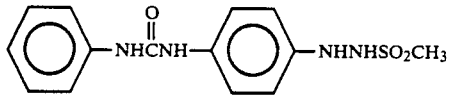
I-24)
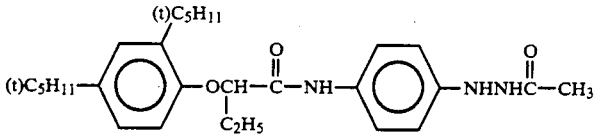
I-25)
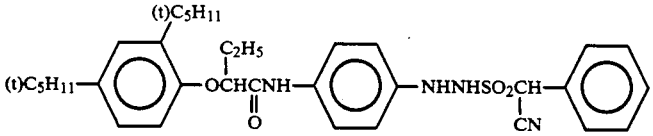
I-26)
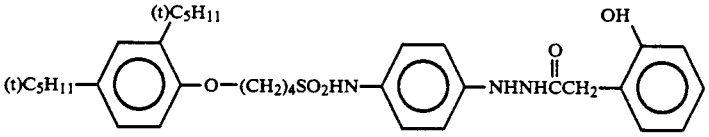
I-27)
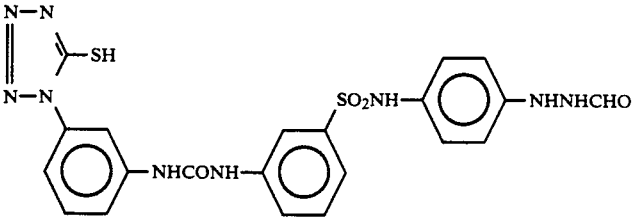

-continued
I-28)
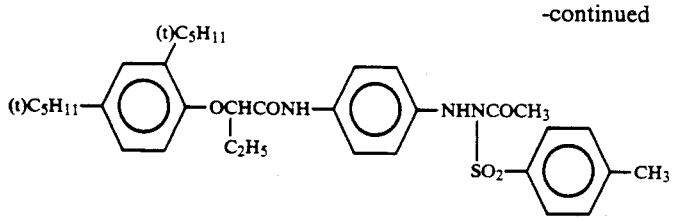
I-29)
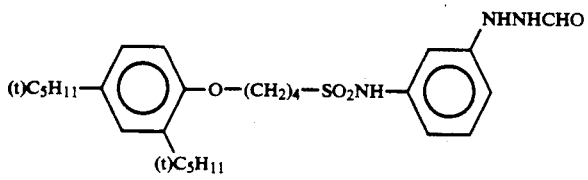
I-30)
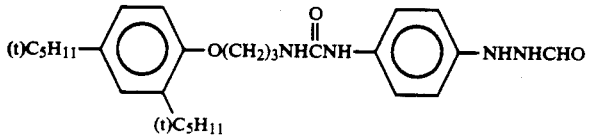
I-31)
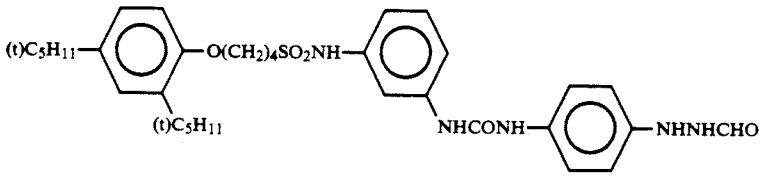
I-32)
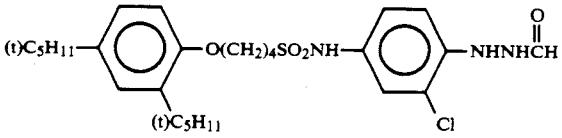
I-33)
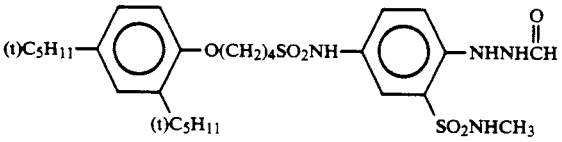
I-34)
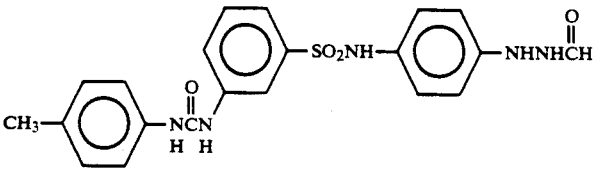
I-35)
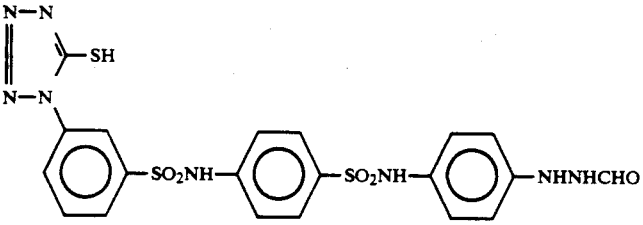
I-36)
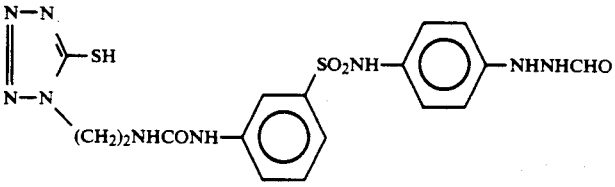

-continued
I-37)
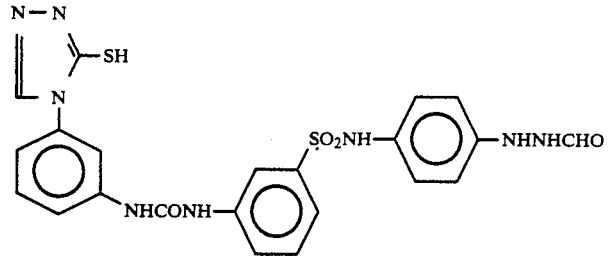
I-38)
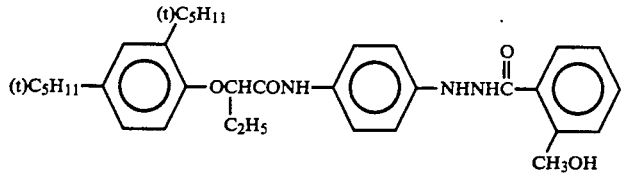
I-39)
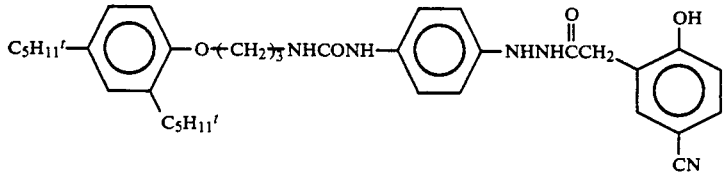
I-40)
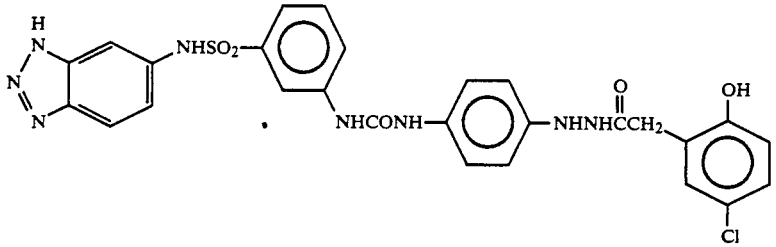
I-41)
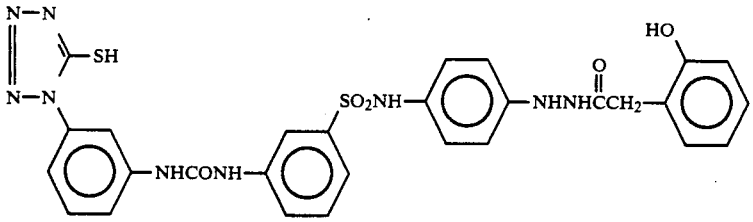
I-42)
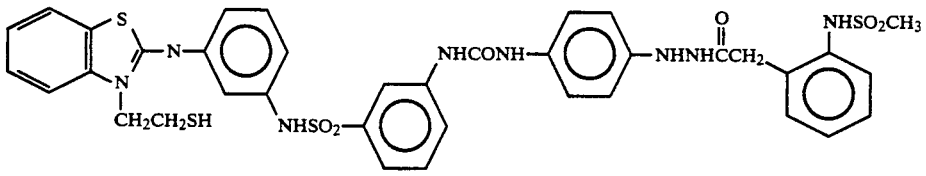
I-43)
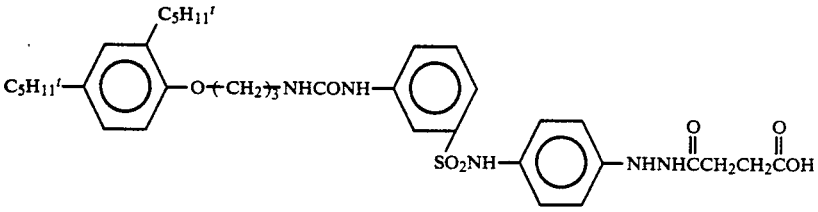

-continued

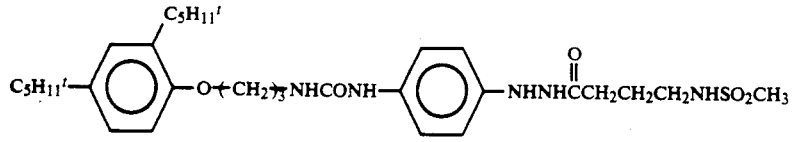

I-44)

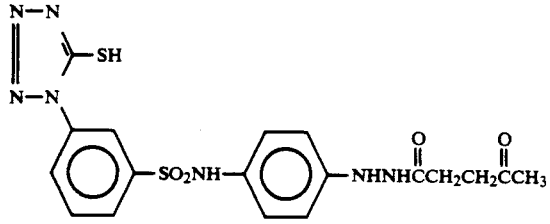

I-45)

The hydrazine derivatives of formula (I) can be used either individually or in combination of two or more thereof. The hydrazine derivative of formula (I) is preferably used in an amount of from $1\times10^{-6}$ to $5\times10^{-2}$ mol, and more preferably from $1\times10^{-5}$ to $2\times10^{-2}$ mol, per mol of silver halide.

The hydrazine derivative of formula (I) is incorporated into a photographic material by adding to a silver halide emulsion or other hydrophilic colloidal solutions in the form of an aqueous solution in case where it is water-soluble or in the form of a solution in a water-miscible organic solvent, such as an alcohol (e.g., methanol and ethanol), an ester (e.g., ethyl acetate), and a ketone (e.g., acetone), in case where it is water-insoluble.

The sensitizing dye having an absorption maximum at a wavelength of from 450 to 580 nm which can be used in the present invention includes cyanine dyes, merocyanine dyes, complex cyanine dyes, complex merocyanine dyes, holopolar cyanine dyes, hemicyanine dyes, styryl dyes, and hemioxonol dyes. Particularly useful are those belonging to cyanine dyes, merocyanine dyes, and complex merocyanine dyes. Any of nuclei commonly employed in cyanine dyes as a basic heterocyclic nucleus is applicable to these dyes. Included in such nuclei are pyrroline, oxazoline, thiazoline, pyrrole, oxazole, thiazole, selenazole, imidazole, tetrazole, and pyridine nuclei; the above-enumerated nuclei to each of which an alicyclic hydrocarbon ring is fused; and the above-enumerated nuclei to each of which an aromatic hydrocarbon ring is fused, e.g., indolenine, benzindolenine, indole, benzoxazole, naphthoxazole, benzothiazole, naphtothiazole, benzoselenazole, benzimidazole, and quinoline nuclei. These nuclei may have a substituent(s) on the carbon atom(s) thereof. Preferred in the present invention are those having an oxazole nucleus or an imidazole nucleus.

To merocyanine dyes or complex merocyanine dyes is applicable a 5- or 6-membered heterocyclic ring as a nucleus having a ketomethylene structure, e.g., pyrazolin-5-one, thiohydantoin, 2-thiooxazolidine-2,4-dione, thiazolidine-2,4-dione, rhodanine, and thiobarbituric acid nuclei.

Specific examples of the sensitizing dyes usable in the present invention are described in *Research Disclosure*, Vol. 176, RD-17643, p. 23 (Dec., 1978), and U.S. Pat. Nos. 4,425,425 and 4,425,426.

Of these dyes particularly preferred are cyanine dyes represented by formula (V) and merocyanine dyes represented by formula (VI):

(V)

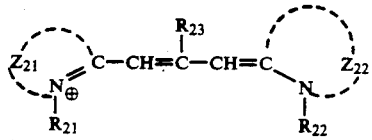

wherein $Z_{21}$ and $Z_{22}$ each represents an atom group necessary to form a thiazole nucleus, a thiazoline nucleus, a benzothiazole nucleus, naphthothiazole nucleus, an oxazole nucleus, a benzoxazole nucleus, an oxazoline nucleus, a naphthoxazole nucleus, an imidazole nucleus, a benzimidazole nucleus, an imidazoline nucleus, a selenazole nucleus, a selenazoline nucleus, a benzoselenazole nucleus, or a naphthoselenazole nucleus; $R_{21}$ and $R_{22}$, which may be the same or different, each represents a substituted or unsubstituted alkyl group, provided that at least one of $R_{21}$ and $R_{22}$ has a sulfo group or a carboxyl group; and $R_{23}$ represents a hydrogen atom or an alkyl group having from 1 to 3 carbon atoms.

The nucleus formed by $Z_{21}$ or $Z_{22}$ may have a substituent(s) as is well known in the art. Examples of the substituents are an alkyl group, an alkoxyl group, an alkoxycarbonyl group, an aryl group, an aralkyl group, and a halogen atom.

The alkyl group as represented by $R_{21}$ or $R_{22}$ preferably includes those having from 1 to 8 carbon atoms, e.g., methyl, ethyl, propyl, butyl, pentyl, and hyptyl groups. Substituents for the alkyl group include a carboxyl group, a sulfo group, a cyano group, a halogen atom (e.g., fluorine, chlorine and bromine atoms), a hydroxyl group, an alkoxycarbonyl group (having not more than 8 carbon atoms, e.g., methoxycarbonyl, ethoxycarbonyl, and benzyloxycarbonyl groups), an alkoxyl group (having not more than 7 carbon atoms, e.g., methoxy, ethoxy, propoxy, butoxy, and benzyloxy groups , an aryloxy group (e.g., phenoxy and p-tolyloxy groups), an acyloxy group (having not more than 3 carbon atoms, e.g., acetyloxy and propionyloxy groups), an acyl group (having not more than 8 carbon atoms, e.g., acetyl, propionyl, benzoyl, and mesyl groups), a carbamoyl group (e.g., carbamoyl, N,N-dimethylcarbamoyl, morpholinocarbamoyl, and piperidinocarbamoyl groups), a sulfamoyl group (e.g., sulfamoyl, N,N-dimethylsulfamoyl, and morpholinosulfamoyl groups), and an aryl group (e.g., phenyl, p-hydroxyphenyl, p-carboxylphenyl, p-sulfophenyl, and α-naphthyl groups). The substituted alkyl group preferably has 6 or less carbon atoms.

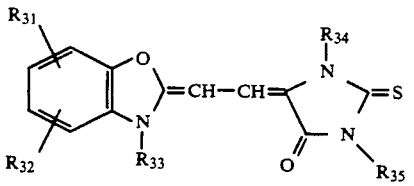

(VI)

wherein $R_{31}$ and $R_{32}$ each represents a hydrogen atom, a halogen atom (e.g., chlorine and bromine atoms), a substituted or unsubstituted alkyl group having from 1 to 8 carbon atoms (e.g., methyl, ethyl, and hydroxyethyl groups , a substituted or unsubstituted alkoxyl group having from 1 to 8 carbon atoms (e.g., methoxy and ethoxy groups), a phenyl group, a naphthyl group, a sulfo group, or a carboxyl group; or $R_{31}$ and $R_{32}$ are connected together to form a 6-membered ring which may be substituted with a halogen atom, a lower alkyl group, a hydroxyl group, a hydroxyalkyl group, a phenyl group, an alkoxyl group, a carboxyl group, etc.; $R_{33}$ represents a substituted or unsubstituted alkyl group (e.g., methyl, ethyl, sulfoethyl, sulfopropyl, sulfoamidoethyl, and sulfobutyl groups) or a substituted or unsubstituted alkenyl group (e.g., allyl group); $R_{34}$ represents a substituted or unsubstituted alkyl group having from 1 to 12 carbon atoms (the substituent preferably includes a hydroxyl group and a carbamido group), which may contain —O—, —OCO—, —NH— or —N— between the carbon atoms thereof; and $R_{35}$ represents a phenyl group, a pyridyl group, or a phenyl or pyridyl group substituted with a halogen atom (e.g., chlorine and bromine atoms), a lower alkyl group (e.g., methyl and ethyl groups), a hydroxyl group, a hydroxyalkyl group (e.g., hydroxyethyl group , an alkoxyl group (e.g., methoxy and ethoxy groups , a sulfo group, or a carboxyl group.

The sensitizing dyes represented by formula (V) can easily be synthesized by known processes, such as those disclosed in JP-A-50-33828, JP-A-55-45015, JP-A-56-25728, and U.S. Pat. Nos. 2,742,833, 2,756,148, and 3,567,458.

The sensitizing dyes represented by formula (VI) can be prepared according to the procedure as described in U.S. Pat No. 2,161,331 and German Patent No. 936,071.

Specific examples of the sensitizing dyes represented by formulae (V) and (VI) are shown below for illustrative purposes only but not for limitation.

V-1

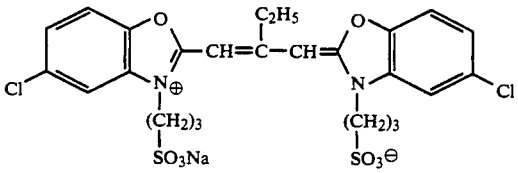

V-2

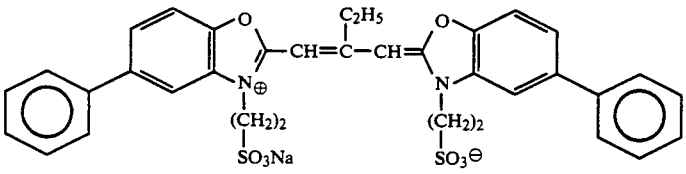

V-3

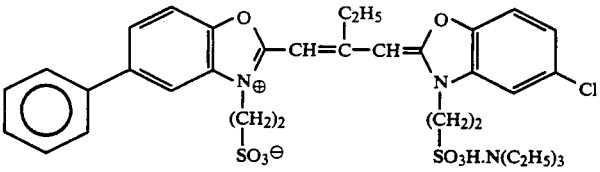

V-4

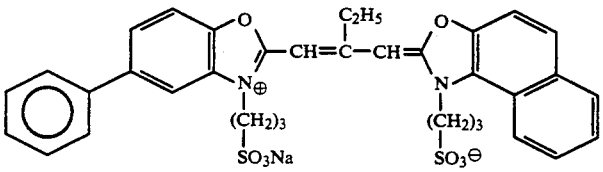

V-5

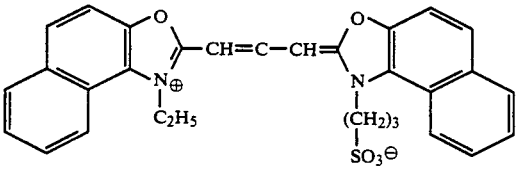

-continued
V-6
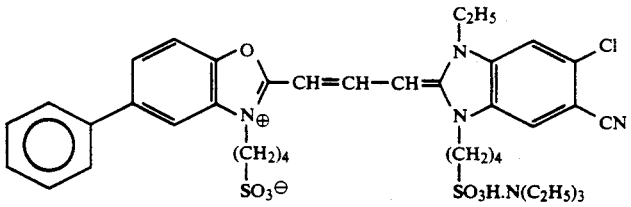
V-7
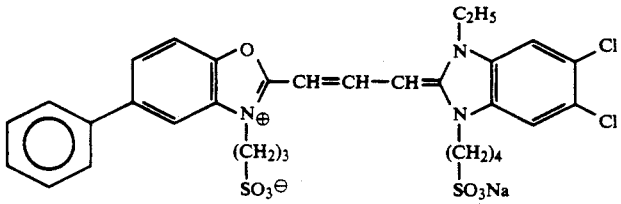
V-8
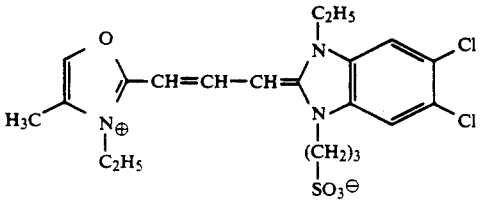
V-9
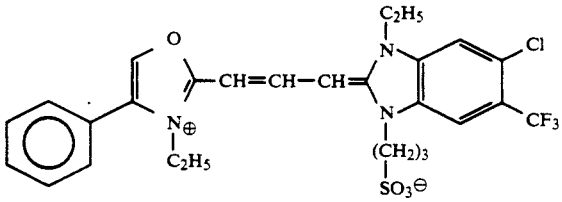
V-10
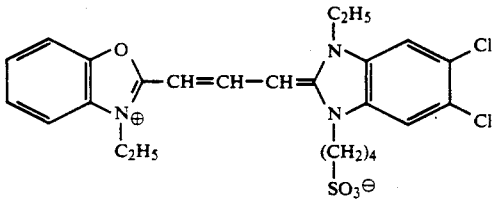
V-11
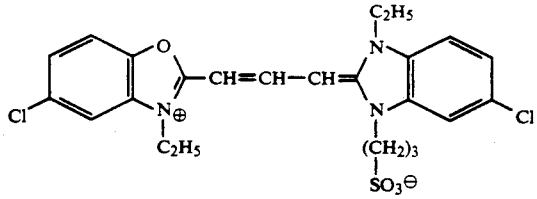
V-12
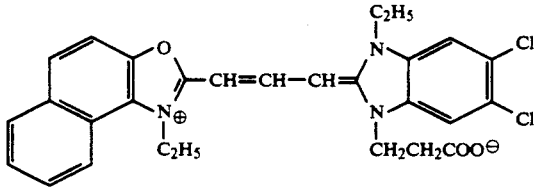
V-13
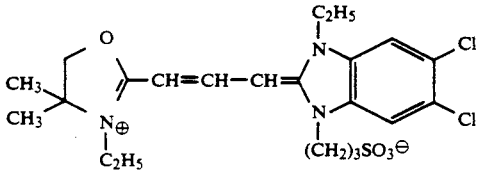

-continued

V-14

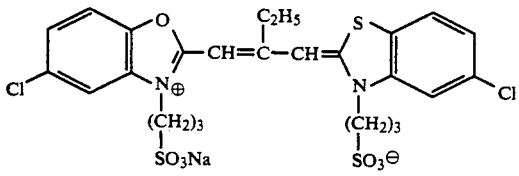

V-15

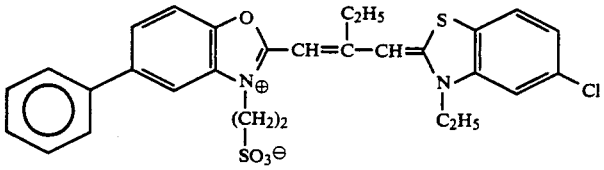

V-16

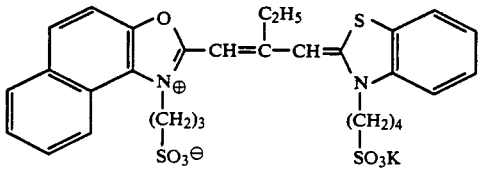

V-17

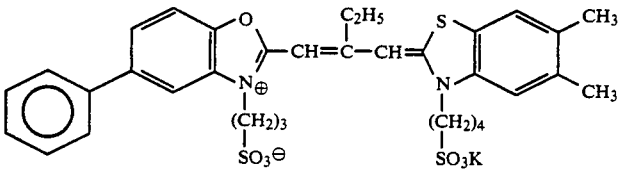

V-18

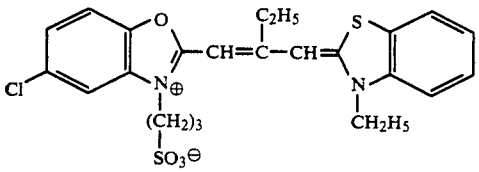

V-19

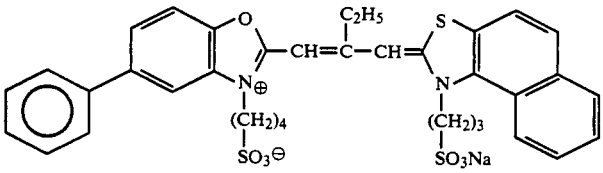

VI-1) 1-(2-Diethylaminoethyl)-5-[(ethylnaphtho[2,1-d]oxazolin-2-ylidene) ethylidene]-3-(pyridin-2-yl)-2-thiohydantoin VI-2) 1-(2-Diethylaminoethyl)-3-(pyridin-4-yl)-5-[3-ethyl-2-benzoxazolinidene) ethylidene]-2-thiohydantoin VI-3) Sodium 1-(2-hydroxyethyl)-3-(4-sulfobutylpyridin-2-yl)5-[(3-sulfopropyl-2-benzoxazolinidene)ethylidene]-2-thiohydantoin VI-4) Sodium1-(2-acetylbutyl)-3-(pyridin-2-yl)-5-[(3-sulfodiethyl-2-benzoxazolinidene) ethylidene]-2-thiohydantoin VI-5) Sodium1-(2-hydroxyethyl-3-(pyridin-2-yl)-5-[(3-sulfopropyl-2-benzoxazolinidene) ethylidene]-2-thiohydantoin VI-6) Sodium1-(2,3-dihydroxypropyl)-3-(pyridin-2-yl)-5-[(3-sulfoamidoethyl-2-benzoxazolinidene)ethylidene]-2-thiohydantoin VI-7) Sodium 1-(2-hydroxyethoxyethyl)-3-(pyridin-2-yl)-5-[(3-sulfobutyl-5-chloro-2-benzoxazolinidene)ethylidene]-2-thiohydantoin VI-8) Sodium 1-(2-hydroxyethoxyethoxyethyl)-3-(pyridin-2-yl)5-[(3-sulfobutyl-5-chloro-2-benzoxazolinidene)ethylidene]-2-thiohydantoin VI-9) Sodium 1-(2-hydroxyethylaminoethyl)-3-(4-chloropyridin2-yl)-5-[(3-sulfobutyl-5-methyl-2-benzoxazolinidene)ethylidene -2-thiohydantoin VI-10) Sodium 1-(2-hydroxyethoxyethyl)-3-(p-ethoxypyridin-2yl)-5-[(3-sulfobutylnaphtho [2,1-d]oxazolin-2-ylidene)ethylidene]-2-thiohydantoin VI-11) Sodium 1-(2-carbamidoethyl)-3-(4-methylpyridin-3-yl)5-[(3-sulfobutylnaphtho [2,1-d]oxazolin-2-ylidene)ethylidene]-2-thiohydantoin The sensitizing dyes are added to a silver halide emulsion in the form of an aqueous solution or a solution in a water-miscible organic solvent, e.g., methanol, ethanol, propyl alcohol, methyl cellosolve, and pyridine.

The sensitizing dyes may be dissolved utilizing ultrasonic vibration as described in U.S. Pat. No. 3,485,634. Other methods employable for adding the sensitizing dyes as dissolved or dispersed to a silver halide emulsion are described in U.S. Pat. Nos. 3,482,981, 3,585,195, 3,469,987, 3,425,835, and 3,342,605, British Patents 1,271,329, 1,038,029, and 1,121,174, and U.S. Pat. Nos. 3,660,101 and 3,658,546.

Addition of the sensitizing dye to an emulsion is generally effected before coating of the emulsion on an appropriate support, but may be effected during chemical ripening or silver halide grain formation.

The sensitizing dye is used in an amount usually of from $1\times10^{-6}$ to $1\times10^{-1}$ mol, and preferably of from $1\times10^{-4}$ to $1\times10^{-2}$ mol, per mol of silver.

The above-described sensitizing dyes may be used either individually or in combination of two or more thereof. A combination of sensitizing dyes is of frequently use for the purpose of supersensitization.

Examples of useful combinations of dyes for supersensitization, and substances exhibiting supersensitization are described in *Research Disclosure*, Vol. 176, No. 17643,p. 23, IV-J (Dec., 1978).

Imagewise exposure to light having wavelengths of from 460 to 600 nm and containing no light having wavelengths of 360 nm or less can be achieved by (1) a method of using an optical filter absorbing ultraviolet light or (2) a method of incorporating a dye (inclusive of an ultraviolet absorbent) having an absorption maximum between 300 nm and 420 nm into a light-sensitive material.

The method (1) of using an optical filter is preferably carried out by employing filters which do not substantially transmit light of 360 nm or less, such as "Sharp Cut Filter SC-38, SC-39, SC-40, SC-41, and SC-46" (produced by Fuji Photo Film Co., Ltd.). More specifically, filters having a transmission of 30% or less, and particularly 10% or less, to light of 360 nm or less are preferred. It is preferable, on the other hand, that the filters to be used have a transmission of at least 50%, and more preferably at least 80%, to light of from 460 to 600 nm. Filters sold under trademarks of SC-48 and SC-50 (produced by Fuji Photo Film Co., Ltd.) and Sheeting Yellow (produced by Eastman Kodak Co., Ltd.) improve image quality but cause considerable reduction in sensitivity and are thus unsuitable for practical use.

In the present invention, the method (2) of incorporating a dye having an absorption maximum in the wavelength of from 300 to 420 nm is preferred to the method (1).

The dyes which can be used in the present invention are dyes (inclusive of ultraviolet absorbents) having an absorption peak in the wavelength region of from 300 to 420 nm, and preferably from 350 to 410 nm. Specific examples of these dyes are described in JP-A-62-210458, JP-A-63-104046, JP-A-63-103235, JP-A-63-208846, JP-A-01-61745 and JP-A-63-314535.

Dyes showing an absorption peak in the wavelength of from 300 to 420 nm which can be preferably employed in the present invention include benzotriazole compounds substituted with an aryl group, 4-thiazolidone compounds, benzophenone compounds, cinnamic ester compounds, butadiene compound, benzoxazole compounds, and ultraviolet absorbing polymers.

Preferred of these dyes are compounds represented by formulae (D-1), (D-2), (D-3), and (D-4) shown below, which have an absorption maximum in the wavelength of from 300 and 420 nm:

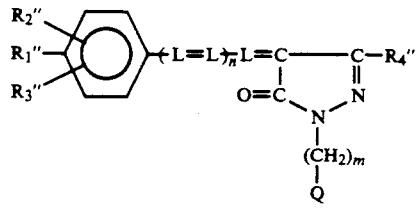

(D-1)

wherein $R_1''$ represents —OX or

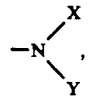

wherein X and Y each represents a hydrogen atom, an alkyl group, a cyanoalkyl group, a carboxyalkyl group, a sulfoalkyl group, a hydroxyalkyl group, or a halogenated alkyl group, or a sodium or potassium salt thereof; $R_2''$ and $R_3''$ each represents a hydrogen atom, a halogen atom, an alkyl group, a hydroxyl group, an alkoxyl group, an alkylthio group or —OX (wherein X is as defined above); Q represents a phenyl group substituted with at least one of a halogen atom, a carboxyl group, a sulfo group, a sulfoalkyl group and a sodium or potassium salt thereof; a sulfoalkyl group; a sulfoalkoxyalkyl group; or a sulfoalkylthioalkyl group; L represents a substituted or unsubstituted methine group; $R_4''$ represents an alkyl group, a carboxyl group, an alkyloxycarbonyl group, an unsubstituted amino group, or an acyl-substituted amino group; m represents 1 or 2; and n represents 0 or 1.

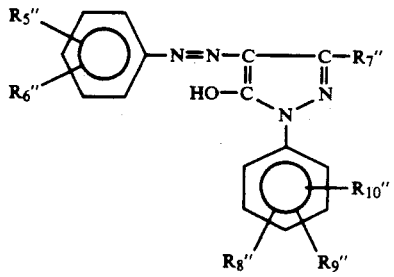

(D-2)

wherein $R_5''$, $R_6''$, $R_8''$, $R_9''$, and $R_{10}''$ each represents a hydrogen atom, a halogen atom, an alkyl group, a hydroxyl group, an alkoxyl group, an amino group, an acylamino group, a carboxyl group, or a sulfo group, or a sodium or potassium salt thereof; and $R_7''$ represents an alkyl group or a carboxyl group.

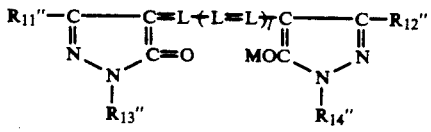

(D-3)

wherein $R_{11}''$ and $R_{12}''$ each represents an alkyl group, a substituted alkyl group, an aryl group, an alkoxycarbonyl group, or a carboxyl group; $R_{13}''$ and $R_{14}''$ each represents (i) an alkyl group substituted with a sulfo or carboxyl group, (ii) a sulfo group, or (iii) an aryl group substituted with a sulfo or carboxyl group, or (iv) a sodium or potassium salt thereof; L represents a substituted or unsubstituted methine group; M represents a hydrogen atom, a sodium atom, or a potassium atom; l represents 0 or 1.

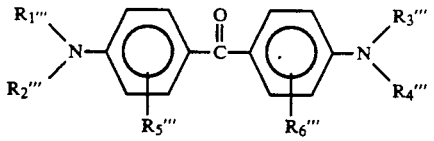

(D-4)

wherein $R_1'''$, $R_2'''$, $R_3'''$, and $R_4'''$ each represents an alkyl group, a hydroxyalkyl group, a cyano group, an alkylcyano group, an alkoxyl group, or a sulfoalkyl group; and $R_5'''$ and $R_6'''$ each represents a sulfo group or an alkylsulfo group.

Specific examples of dyes which can be preferably used in this invention are shown below for illustrative purposes only but not for limitation.

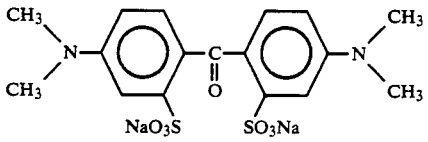

D-1

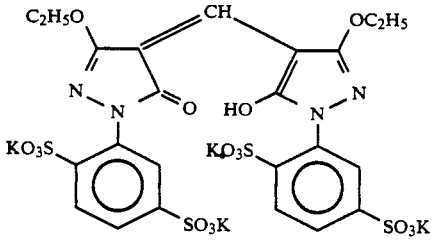

D-2

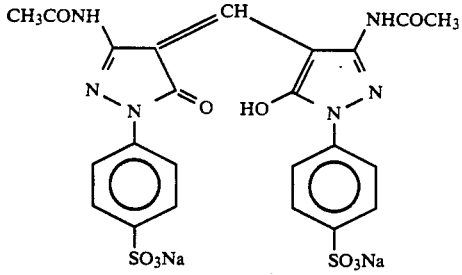

D-3

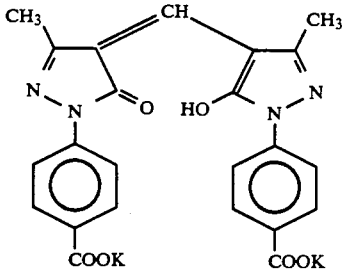

D-4

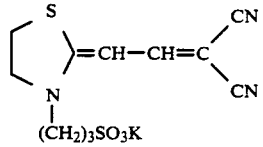

D-5

-continued

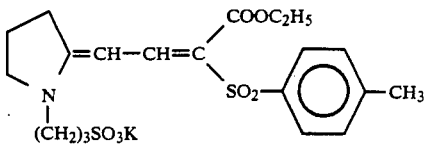

D-6

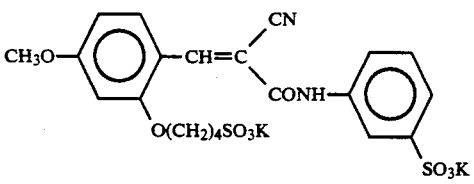

D-7

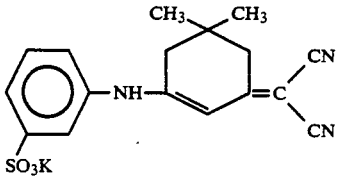

D-8

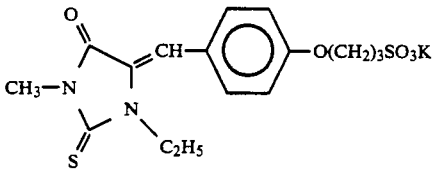

D-9

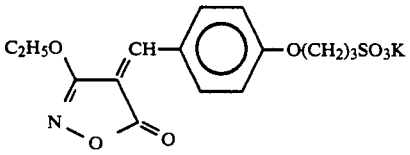

D-10

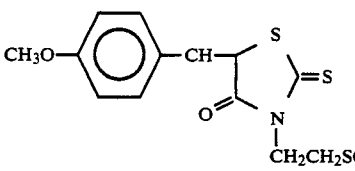

D-11

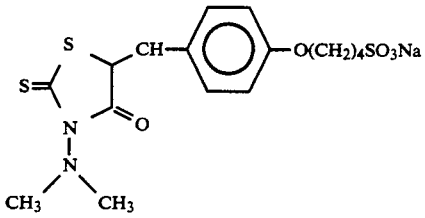

D-12

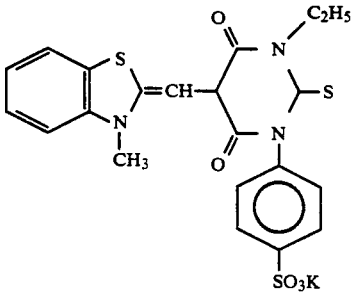

D-13

-continued

D-14

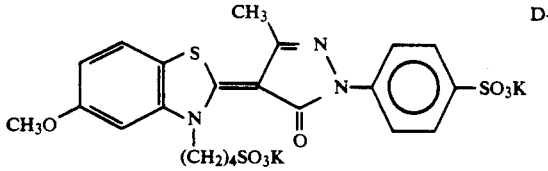

D-15

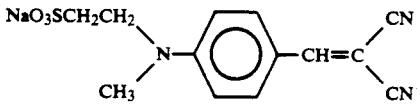

D-16

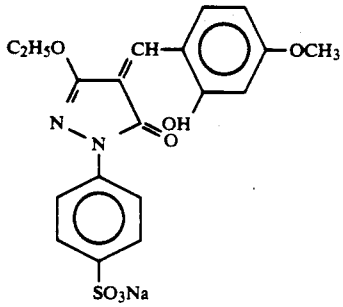

D-17

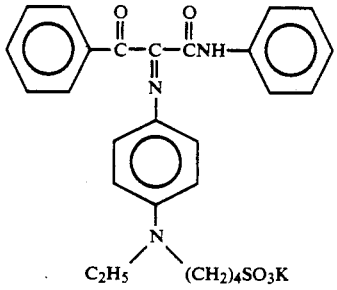

D-18

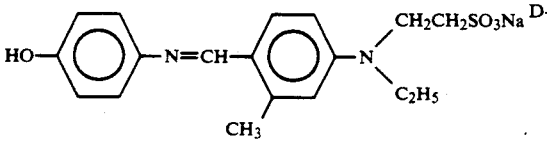

D-19

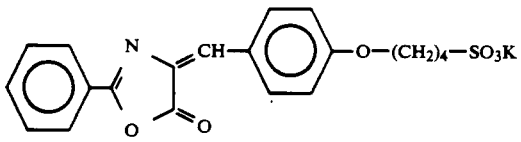

D-20

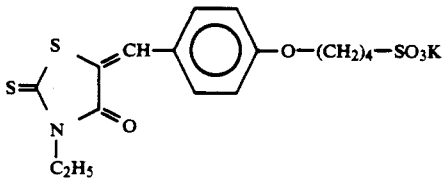

D-21

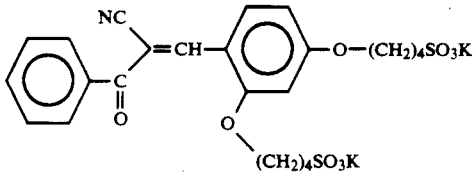

-continued

D-22

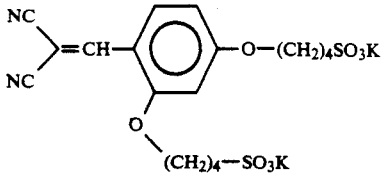

D-23

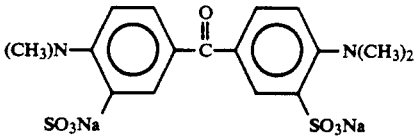

D-24

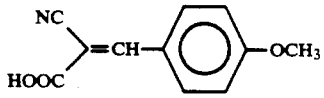

D-25

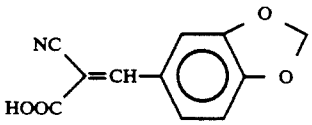

D-26

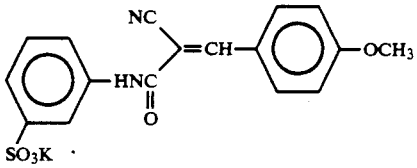

D-27

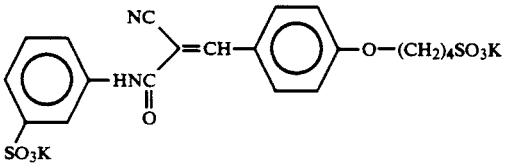

These dyes are incorporated into any of emulsion layers, intermediate layers, protective layers, and other hydrophilic colloidal layers. The dyes may be substantially fixed in arbitrary layer by mordanting. In this case, the dye is preferably present in an emulsion layer or a layer farther than an emulsion layer from a support. Mordants which can be used for fixing the dye are described in JP-B-43-10254 (the term "JP-B" as used herein means an "examined published Japanese patent publication") and U.S. Pat. Nos. 2,548,564, 2,882,156, and 3,444,138.

Dispersions of microcystalline dye particles disclosed in WO-8804794 can also be employed.

Additionally included in dyes which can be used in the present invention to advantage are functional dyes which are decolored in a developer as disclosed in JP-A-63-208846 and JP-A-01-61745. Specific examples of such functional dyes are shown below.

D-28
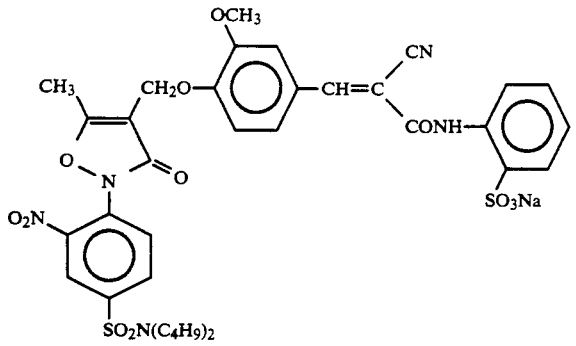
D-29
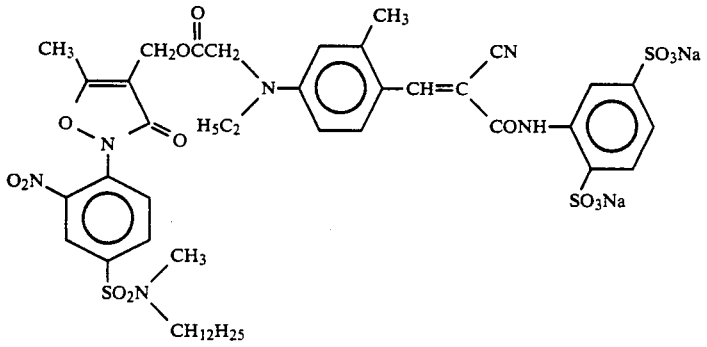
D-30
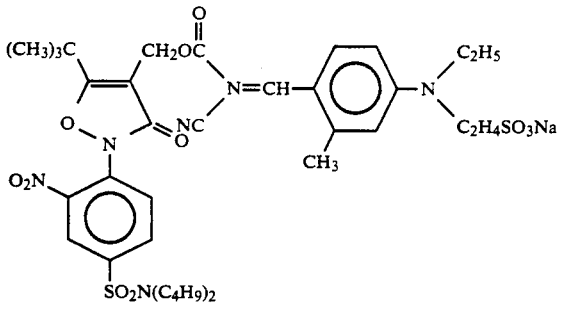
D-31
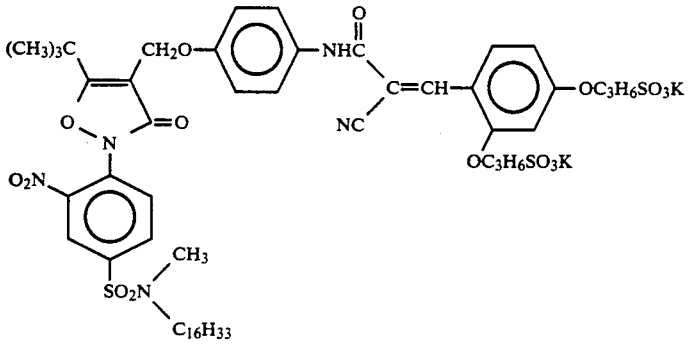

-continued
D-32
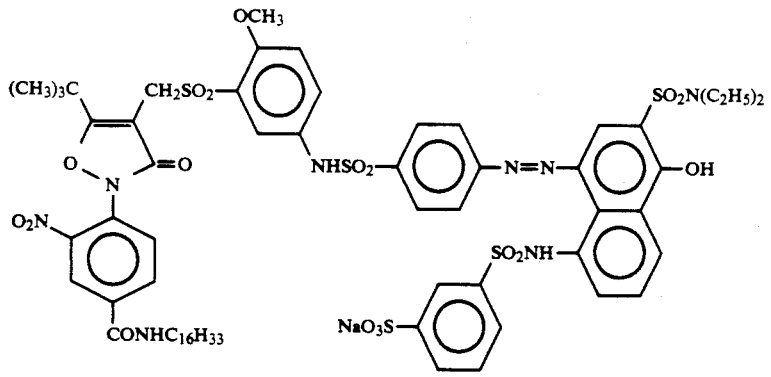
D-33
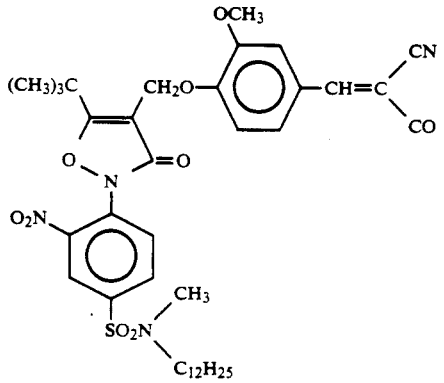
D-34
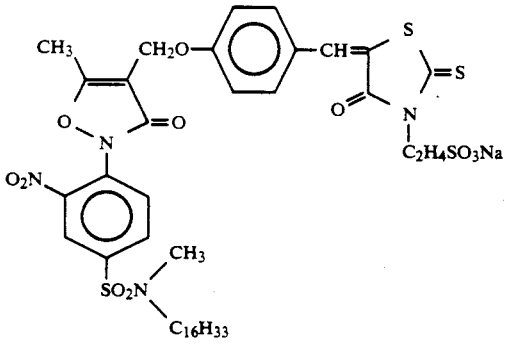
D-35
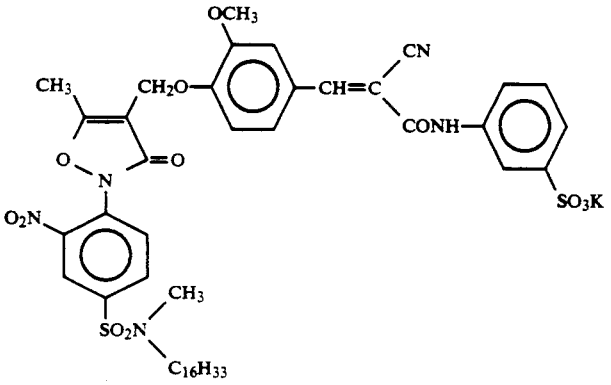

-continued

D-36

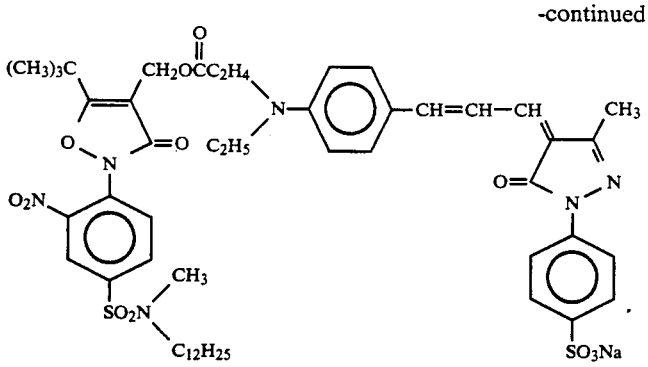

These dyes or ultraviolet absorbents can be used either individually or in combinations of two or more thereof. The amount of the dyes to be added ranges usually from $1\times10^{-2}$ to 1 g/m$^2$ and preferably from 50 to 500 mg/m$^2$, though varying depending on the molar absorption coefficient of the dye.

The dye can be incorporated into any of hydrophilic colloidal solutions in the form of a solution in an appropriate solvent, such as water, alcohols (e.g., methanol, ethanol, and propanol), acetone, methyl cellosolve, etc. and mixtures thereof.

Light sources which can be used in the image formation system according to the present invention include halogen lamps, xenon light sources, and fluorescent lamps. The effects of the present invention are particularly remarkable in using a xenon light source.

In the present invention, the above-described dyes having an absorption maximum in the wavelength of from 300 to 420 nm are preferably used in combination with at least one compound selected from the group consisting of compounds represented by formulae (II) and (III) shown below to thereby reduce black pepper and light source dependence and improve image quality in enlargement or reduction work.

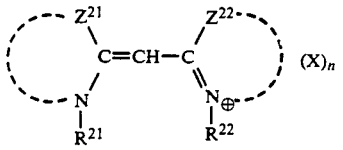

(II)

wherein $Z^{21}$ and $Z^{22}$ each represents a non-metallic atom group necessary to form a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, or a quinoline nucleus; $R^{21}$ and $R^{22}$ each represents an alkyl group or a substituted alkyl group; X represents a charge balancing counter ion; and n represents 0 or 1.

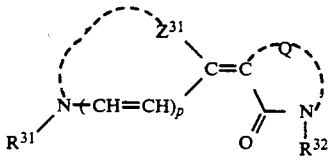

(III)

wherein $Z^{31}$ represents a non-metallic atom group necessary to form a thiazoline nucleus, a thiazolidine nucleus, a selenazoline nucleus, a selenazolidine nucleus, a pyrrolidine nucleus, a dihydropyridine nucleus, an oxazoline nucleus, an oxazolidine nucleus, an imidazoline nucleus, an indoline nucleus, a tetrazoline nucleus, a benzothiazoline nucleus, a benzoselenazoline nucleus, a benzimidazoline nucleus, a benzoxazoline nucleus, a naphthothiazoline nucleus, a naphthoselenazoline nucleus, a naphthoxazoline nucleus, a naphthoimidazoline nucleus, or a dihydroquinoline nucleus; Q represents a non-metallic atom group necessary to form a rhodanine nucleus, a 2-thiooxazoline-2,4-dione nucleus, a 2-thioselenazoline-2,4-dione nucleus, a 2-thiohydantoin nucleus, a barbituric acid nucleus, or a 2-thiobarbituric acid nucleus; $R^{31}$ and $R^{32}$ each represents a hydrogen atom, an alkyl group, or an aryl group; and p represents 0 or 1.

Where the compound represented by formula (II) has a radical, preferred is the compound with one hydrogen atom being released from the atom group represented by $Z^{21}$ or $Z^{22}$ or the group represented by $R^{21}$ or $R^{22}$, and more preferred is the compound with one hydrogen atom being released from $R^{21}$ or $R^{22}$.

In formula (II), the heterocyclic ring formed by $Z^{21}$ or $Z^{22}$ is preferably a benzoxazole nucleus, a benzothiazole nucleus, a naphthoxazole nucleus, a naphthothiazole nucleus, a thiazole nucleus, or an oxazole nucleus, and more preferably a benzoxazole nucleus, a benzothiazole nucleus, or a naphthoxazole nucleus. The heterocyclic ring formed by $Z^{21}$ or $Z^{22}$ may have one or more substituents selected from, for example, a halogen atom (e.g., fluorine, chlorine, bromine and iodine atoms), a nitro group, an alkyl group (preferably having from 1 to 4 carbon atoms, e.g., methyl, ethyl, trifluoromethyl, benzyl and phenethyl groups), an aryl group (e.g., phenyl group), an alkoxyl group (preferably having from 1 to 4 carbon atoms, e.g., methoxy, ethoxy, propoxy, and butoxy groups), a carboxyl group, an alkoxycarbonyl group (preferably having from 2 to 5 carbon atoms, e.g., ethoxycarbonyl group), a hydroxyl group, and a cyano group.

The alkyl group as represented by $R^{21}$ or $R^{22}$ includes substituted or unsubstituted alkyl groups. Unsubstituted alkyl groups preferably contains not more than 18 carbon atoms, and more preferably not more than 8 carbon atoms, including methyl, ethyl, n-propyl, n-butyl, n-hexyl, and n-octadecyl groups. Substituted alkyl groups preferably contains not more than 6, more preferably not more than 4, carbon atoms in the alkyl moiety thereof. Examples of the substituted alkyl group are an alkyl group substituted with a sulfo group (the sulfo group may be bonded via an alkoxyl group, an aryl group, etc.) (e.g., 2-sulfoethyl, 3-sulfopropyl, 3-sulfobutyl, 4-sulfobutyl, 2-(3-sulfopropoxy)ethyl, 2-[2-(3-sulfo-propoxy)ethoxy]ethyl, 2-hydroxy-3-sulfopropyl, p-sulfophenethyl, and p-sulfophenylpropyl groups), an alkyl group substituted with a carboxyl group (the carboxyl group may be bonded via an alkoxyl group, an aryl group, etc.) (e.g., carboxymethyl, 2-carboxyethyl, 3-carboxypropyl, and 4-carboxybutyl groups), a hydroxyalkyl group (e.g., 2-hydroxyethyl and 3-hydroxypropyl groups), an acyloxyalkyl group (e.g., 2-acetoxyethyl and 3-acetoxypropyl groups), an alkoxyalkyl group (e.g., 2-methoxyethyl and 3-methoxypropyl groups), an alkoxycarbonylalkyl- group (e.g., 2-methoxycarbonylethyl, 3-methoxycarbonylpropyl, and 4-ethoxycarbonylbutyl groups), a vinyl-substituted alkyl group (e.g., allyl group), a cyanoalkyl group (e.g., 2-cyanoethyl group), a carbamoylalkyl group (e.g., 2-carbamoylethyl group), an aryloxyalkyl group (e.g., 2-phenoxyethyl and 3-phenoxypropyl groups), an aralkyl group (e.g., 2-phenethyl and 3-phenylpropyl groups), and an aryloxyalkyl group (e.g., 2-phenoxyethyl and 3-phenoxypropyl groups).

It is preferable that at least one of the groups as represented by $R^{21}$ and $R^{22}$ is an alkyl group having a sulfo group or a carboxyl group.

When in formula (II) is 1, the charge balancing counter ion as represented by X is an arbitrarily selected anion capable of offsetting a positive charge generated by a quaternary ammonium salt in the heterocyclic ring. Examples of suitable anions are bromide, chloride, iodide, p-toluenesulfonate, ethylsulfonate, perchlorate, trifluoromethanesulfonate and thiocyanate ions.

Where the heterocyclic quaternary ammonium salt further contains an anionic substituent such as a sulfoalkyl group, the compound of formula (II) may have a form of a betaine. This being the case, no counter ion is needed (n is 0). Where the heterocyclic quaternary ammonium salt has two anionic substituents, such as two sulfoalkyl groups, X is a cationic counter ion and includes an alkali metal ion (e.g., $Na^+$ and $K^+$) and an ammonium salt (e.g., triethylammonium).

Where the compound represented by formula (III) has a radical, preferred are the compounds with one hydrogen atom being released from the atom group represented by $Z^-$ or Q or the group represented by $R^{31}$ or $R^{32}$, and more preferably the compounds with one hydrogen atom being released from $R^{31}$ or $R^{32}$.

In formula (III), the heterocyclic ring formed by $Z^{31}$ includes a thiazoline nucleus (e.g., thiazoline, 4-methylthiazoline, 4-phenylthiazoline, 4,5-dimethylthiazoline, and 4,5-diphenylthiazoline nuclei), a benzothiazoline nucleus (e.g., benzothiazoline, 4-chlorobenzothiazoline, 5-chlorobenzothiazoline, 6-chlorobenzothiazoline, 7-chlorobenzothiazoline, 5-nitrobenzothiazoline, 6-nitrobenzothiazoline, 4-methylbenzothiazoline, 5-methylbenzothiazoline, 6-methylbenzothiazoline, 5-bromobenzothiazoline, 6-bromobenzothiazoline, 5-iodobenzothiazoline,5-methoxybenzothiazoline,6-methoxybenzothiazoline, 5-ethoxybenzothiazoline, 5-propoxybenzothiazoline, 5-butoxybenzothiazoline, 5-carboxybenzothiazoline, 5-ethoxycarbonylbenzothiazoline, 5-phenethylbenzothiazoline, 5-fluorobenzothiazoline, 5-chloro-6-methylbenzothiazoline, 5-trifluoromethylbenzothiazoline, 5,6-dimethylbenzothiazoline, 5-hydroxy-6-methylbenzothiazoline, tetrahydrobenzothiazoline, 4-phenylbenzothiazoline, and 5-phenylbenzothiazoline nuclei), a naphthothiazoline nucleus (e.g., naphtho[2,1-d]thiazoline, naphtho[1,2-d]thiazoline, naphtho[2,3-d]thiazoline, 5-methoxynaphtho[1,2-d]thiazoline, 7-ethoxynaphtho[2,1-d]thiazoline, 8-methoxynaphtho[2,1-d]thiazoline, and 5-methoxynaphtho[2,3-d]thiazoline nuclei), a thiazolidine nucleus (e.g., thiazolidine, 4-methylthiazolidine, and 4-nitrothiazolidine nuclei), an oxazoline nucleus (e.g., oxazoline, 4-methyloxazoline, 4-nitroxazoline, 5-methyloxazoline, 4-phenyloxazoline, 4,5-diphenyloxazoline, and 4-ethyloxazoline nuclei), a benzoxazoline nucleus (e.g., benzoxazoline,5-chlorobenzoxazoline, 5-methylbenzoxazoline,5-bromobenzoxazoline, 5-fluorobenzoxazoline, 5-phenylbenzoxazoline, 5-methoxybenzoxazoline, 5-nitrobenzoxazoline, 5-trifluoromethylbenzoxazoline, 5-hydroxybenzoxazoline, 5carboxybenzoxazoline, 6-methylbenzoxazoline, 6-chlorobenzoxazoline, 6-nitrobenzoxazoline, 6-methoxybenzoxazoline, 6-hydroxybenzoxazoline, 5,6-dimethylbenzoxazoline, and 5-ethoxybenzoxazoline nuclei), a naphthoxazoline nucleus (e.g., naphtho[2,1-d]oxazoline, naphtho[1,2-d]oxazoline, naphtho[2,3-d]oxazoline, and 5-nitronaphtho[2,1-d]oxazoline nuclei), an oxazolidine nucleus (e.g., 4,4-dimethyloxazolidine nucleus), a selenazoline nucleus (e.g., 4-methylselenazoline, 4-nitroselenazoline, and 4-phenylselenazoline nuclei), a selenazolidine nucleus (e.g., selenazolidine, 4-methylselenazolidine, and 4-phenylselenazolidine nuclei), a benzoselenazoline nucleus (e.g., benzoselenazoline, 5-chlorobenzoselenazoline, 5-nitrobenzoselenazoline, 5-methoxybenzoselenazoline, 5-hydroxybenzoselenazoline, 6-nitrobenzoselenazoline, and 5-chloro-6-nitrobenzoselenazoline nuclei), a naphthoselenazoline nucleus (e.g., naphtho[2,1-d]selenazoline and naphtho[1,2-d]selenazoline nuclei), a 3,3-dialkylindoline nucleus (e.g., 3,3-dimethylindoline, 3,3-diethylindoline, 3,3-dimethyl-5-cyanoindoline, 3,3-dimethyl-6-nitroindoline, 3,3-dimethyl-5-nitroindoline, 3,3-dimethyl-5-methoxyindoline, 3,3-dimethyl-5-methylindoline, and 3,3-dimethyl-5-chloroindoline nuclei), an imidazoline nucleus (e.g., 1-alkylimidazoline, 1-alkyl-4-phenylimidazoline, and 1-arylimidazoline nuclei), a benzimidazoline nucleus (e.g., 1-alkylbenzimidazoline, 1-alkyl-5-chlorobenzimidazoline, 1-alkyl-5,6-dichlorobenzimidazoline, 1-alkyl-5-methoxybenzimidazoline, 1-alkyl-5-cyanobenzimidazoline, 1-alkyl-5-fluorobenzimidazoline, 1-alkyl-5-trifluoromethylbenzimidazoline, 1-allyl-5,6-dichlorobenzimidazoline, 1-arylbenzimidazoline, 1-aryl-5-chlorobenzimidazoline, 1-aryl-5,6-dichlorobenzimidazoline, 1-aryl-5-methoxybenzimidazoline, and 1-aryl-5-cyanobenzimidazoline nuclei), a naphthoimidazoline nucleus (e.g., 1-alkylnaphtho[1,2-d]imidazoline and 1-arylnaphtho[1,2-d]imidazoline nuclei) [the term "alkyl" as used above preferably includes those having from 1 to 8 carbon atoms, either unsubstituted or substituted with a hydroxyl group, etc., e.g., methyl, ethyl, propyl, isopropyl, butyl, 2-hydroxyethyl, and 3-hydroxypropyl groups; and the term "aryl" as used above includes a phenyl group or a phenyl group substituted with a halogen atom (e.g., chlorine), an alkyl group (e.g., methyl), or an alkoxyl group (e.g., methoxy)], a pyrrolidine nucleus (e.g., 2-pyrrolidine nucleus), a dihydropyridine nucleus (e.g., 1,4-dihydropyridine, 5-methyl-1,2-dihydropyridine, and 3-methyl-1,4-dihydropyridine nuclei), a dihydroquinoline nucleus (e.g., 1,4-dihydroquinoline, 3-methyl1,2-dihydroquinoline, 5-ethyl-1,2-dihydroquinoline, 6-methyl1,2-dihydroquinoline, 6-nitro-1,2-dihydroquinoline, 8-fluoro1,2-dihydroquinoline, 6-methoxy-1,2-dihydroquinoline, 6-hydroxy-1,2-dihydroquinoline, 8-chloro-1,2-dihydroquinoline, 6-ethoxy-1,4-dihydroquinoline, 6-nitro-1,4-dihydroquinoline, 8-chloro- 1,4-dihydroquinoline, 8-fluoro-1,4-dihydroquinoline, 8-methyl-1,4-dihydroquinoline, 8-methoxy-1,4-dihydroquinoline, dihydroisoquinoline,6-nitro-1,2-isoquinoline,and 6-nitro-2,3-dihydroisoquinoline nuclei), and a tetrazoline nucleus.

Preferred of them are oxazoline, oxazolidine, thiazoline, benzothiazoline, thiazolidine, benzoxazoline, naphthoxazoline, selenazoline, selenazolidine, benzoselenazoline, benzimidazoline, pyrrolidine, dihydropyridine, and tetrazoline nuclei. More preferred are oxazoline, oxazolidine, benzoxazoline, thiazoline, thiazolidine, selenazoline, selenazolidine, benzimidazoline, pyrrolidine and dihydropyridine nuclei. Most preferred are oxazoline, oxazolidine, benzoxazoline, thiazoline, thiazolidine, benzimidazoline and pyrrolidine nuclei.

$R^{31}$ and $R^{32}$ each represents a hydrogen atom, an unsubstituted alkyl group having from 1 to 18 carbon atoms, preferably from 1 to 8 carbon atoms (e.g., methyl, ethyl, propyl, isopropyl, butyl, hexyl, dodecyl, and octadecyl groups), a substituted alkyl group [such as an aralkyl group (e.g., benzyl and β-phenylethyl groups), a hydroxyalkyl group (e.g., 2-hydroxyethyl, 3-hydroxypropyl, and 2-hydroxyethoxyethyl groups), a carboxyalkyl group (e.g., carboxymethyl, 2carboxyethyl, 3-carboxypropyl, and 4-carboxybutyl groups), an alkyl group substituted with a sulfo group (the sulfo group may be bonded to the alkyl group via an alkoxyl group, an aryl group, etc.) (e.g., 2-sulfoethyl, 3-sulfopropyl, 3-sulfobutyl, 4-sulfobutyl, 2-[3-sulfopropoxy]ethyl, 2-hydroxy-3-sulfopropyl, 2-[2-(3-sulfopropoxy)ethoxy]ethyl, and p-sulfophenethyl groups), a sulfate alkyl group (e.g., 3-sulfate propyl and 4-sulfate butyl groups), a vinyl-substituted alkyl group (e.g., allyl group), an acyloxyalkyl group (e.g., 2-acetoxyethyl and 3-acetoxypropyl groups), an alkoxyalkyl group (e.g., 2-methoxyethyl and 3-methoxypropyl groups), an alkoxycarbonylalkyl group (e.g., 2-methoxycarbonylethyl, 3-methoxycarbonylpropyl, and 4-ethoxycarbonylbutyl groups), a cyanoalkyl group (e.g., 2-cyanoethyl group), a carbamoylalkyl group (e.g., 2-carbamoylethyl group), an aryloxyalkyl group (e.g., 2-phenoxyethyl and 3-phenoxypropyl groups), an aryloxyalkyl group (e.g., 2-phenoxyethyl and 3-phenoxypropyl groups), a mercaptoalkyl group (e.g., 2-mercaptoethyl and 3-mercaptopropyl groups), and an alkylthioalkyl group (e.g., 2-methylthioethyl group)], or an aryl group (e.g., phenyl, tolyl, naphthyl, methoxyphenyl, and chlorophenyl groups).

At least one of $R^{31}$ and $R^{32}$ preferably represents an alkyl group having a sulfo group or a carboxyl group.

The heterocyclic ring formed by Q includes a rhodanine nucleus, a 2-thiooxazoline-2,4-dione nucleus, a 2-thioselenazoline-2,4-dione nucleus, a barbituric or thiobarbituric acid nucleus [such as a barbituric or thiobarbituric acid nucleus containing a 1-alkyl group (e.g., 1-methyl, 1-ethyl, 1-propyl, and 1-butyl groups), a 1,3-dialkyl group (e.g., 1,3-dimethyl, 1,3-diethyl, 1,3-dipropyl, 1,3-diisopropyl, 1,3-dicyclohexyl, and 1,3-di(β-methoxyethyl) groups), a 1,3-diaryl group (e.g., 1,3-diphenyl, 1,3-di(p-chlorophenyl), and 1,3-di(p-ethoxycarbonylphenyl) groups], a 1-sulfoalkyl group (e.g., 1-(2-sulfoethyl), 1-(3-sulfopropyl), and 1-(4-sulfobutyl) groups), a 1,3-disulfoalkyl group (e.g., 1,3-di(2-sulfoethyl), 1,3-di(3-sulfopropyl), and 1,3-di(4-sulfocyclohexyl) groups), a 1,3-di(sulfoaryl) group (e.g., 1,3-di(4-sulfophenyl) group), or a 1-sulfoaryl group (e.g., 1-(4-sulfophenyl) group)], or a thiohydantoin nucleus (the substituent at the 1-position thereof is selected from the atom or groups as represented by $R^{32}$ at the 3-position and may be the same or different from $R^{32}$).

Preferred of these heterocyclic rings are rhodanine and thiohydantoin nuclei, with a rhodanine nucleus being more preferred.

Specific examples of the compounds represented by formulae (II) and (III) are shown below for illustrative purposes only but not for limitation.

II-1

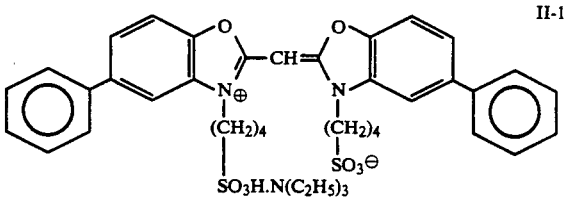

II-2

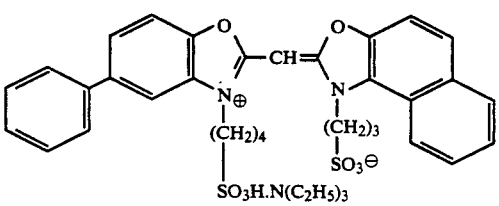

II-3

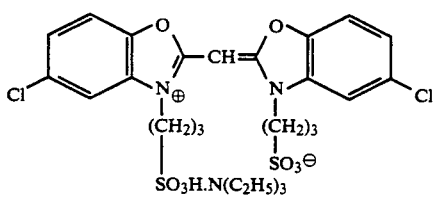

II-4

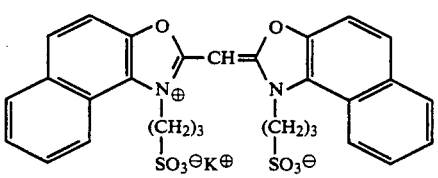

II-5

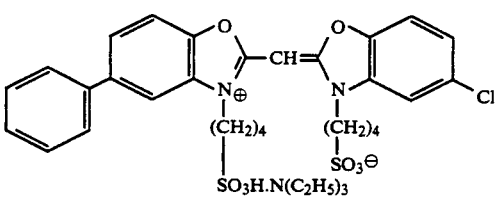

II-6

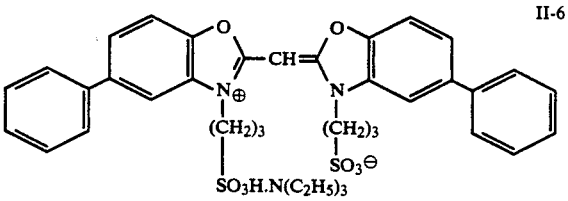

II-7

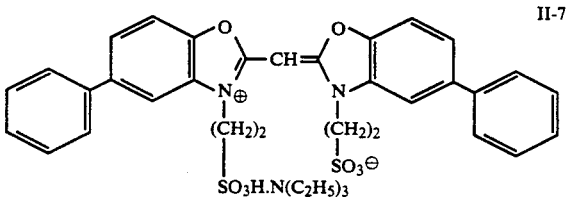

-continued
II-8
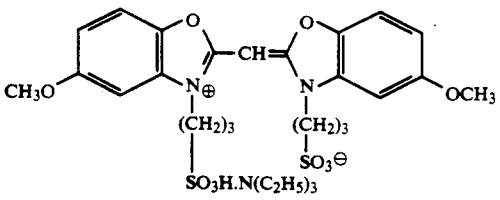
II-9
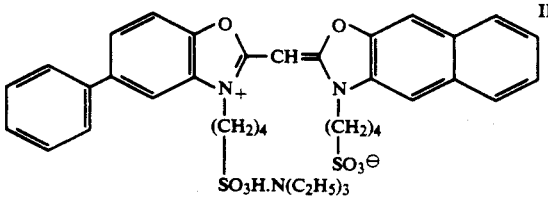
II-10
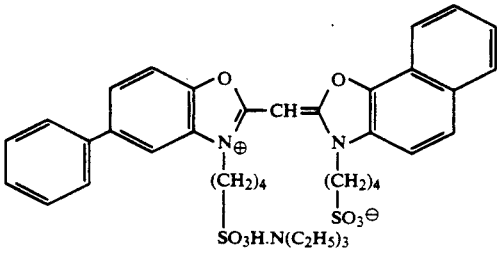
II-11
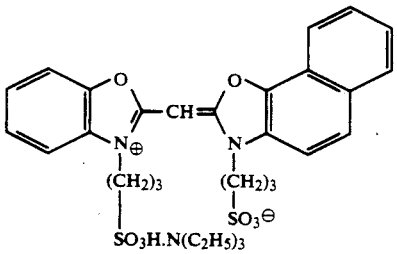
II-12
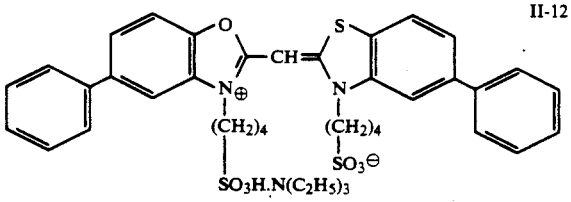
II-13
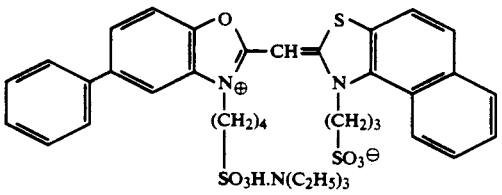
II-14
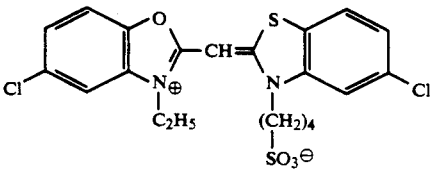
-continued
II-15
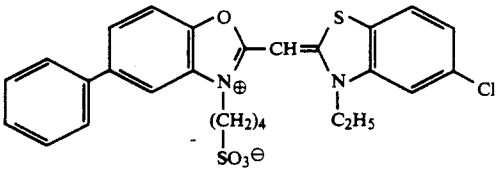
II-16
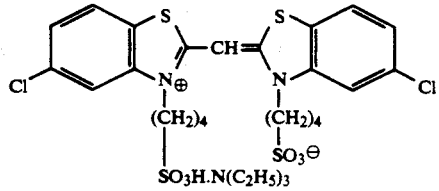
II-17
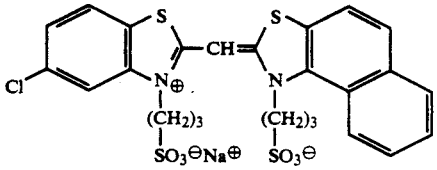
II-18
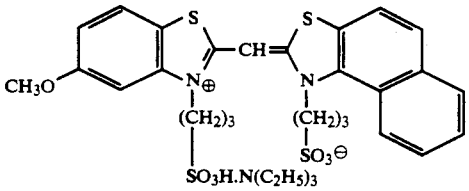
II-19
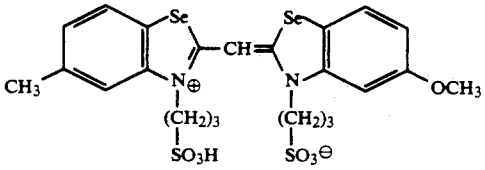
II-20
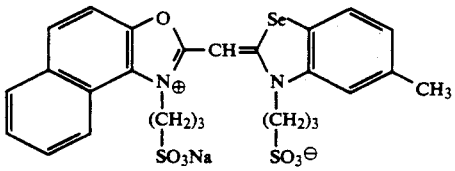
II-21
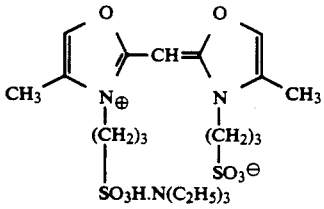
II-22
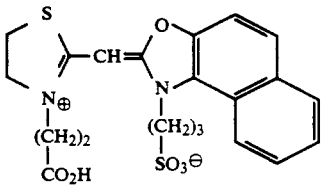

-continued
II-23
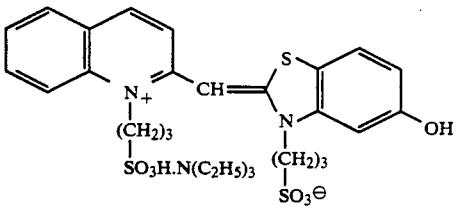
II-24
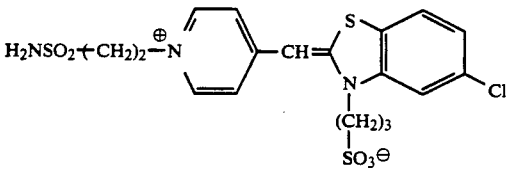
II-25
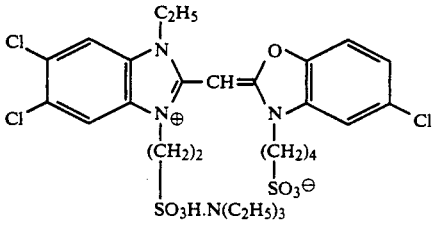
II-26
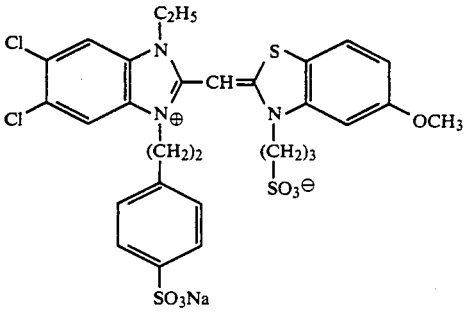
II-27
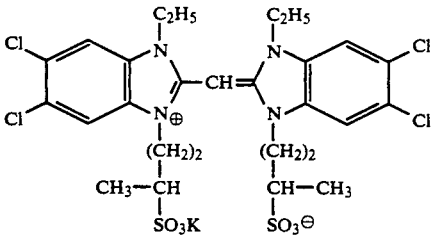
II-28
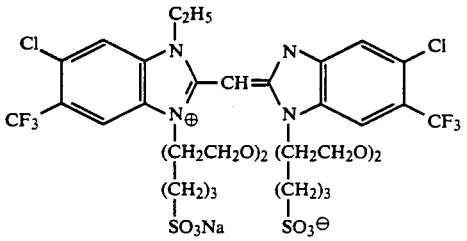
-continued
II-29
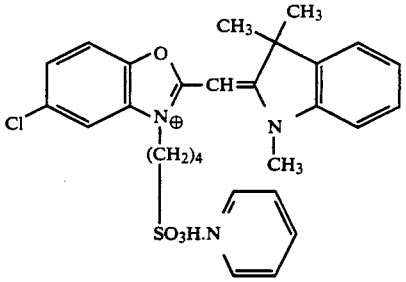
II-30
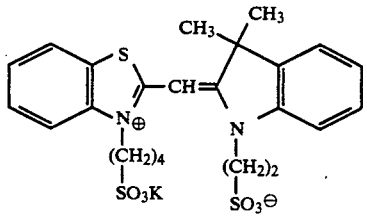
III-1
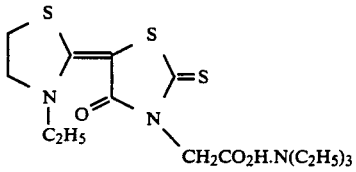
III-2
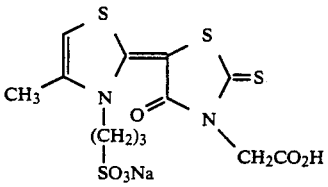
III-3
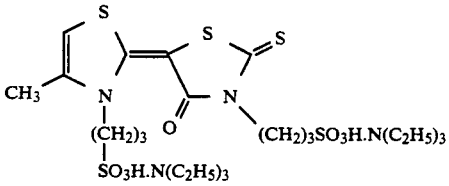
III-4
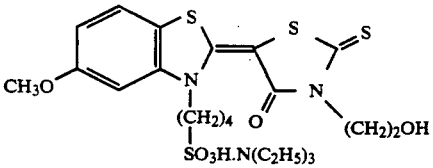
III-5
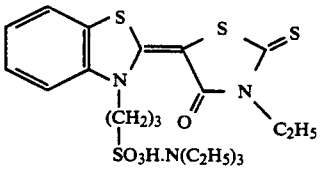
III-6
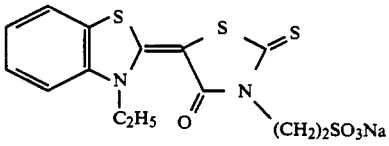

-continued
III-7
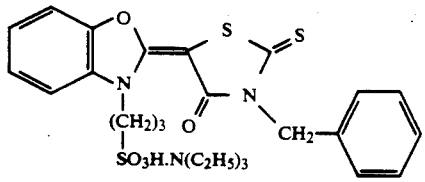
III-8
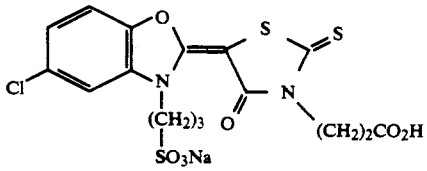
III-9
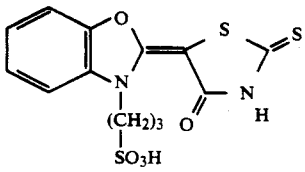
III-10
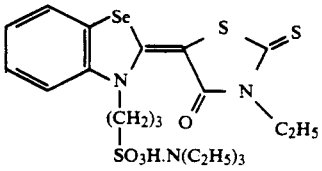
III-11
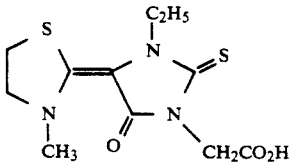
III-12
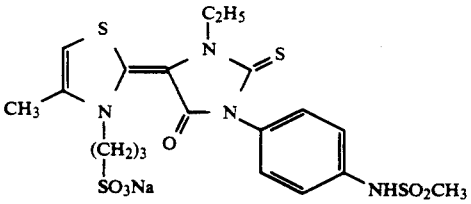
III-13
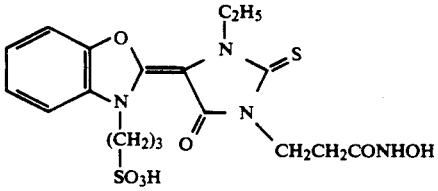
III-14
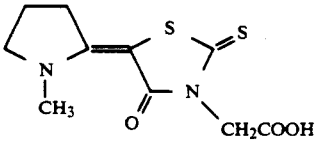
-continued
III-15
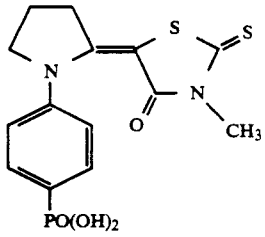
III-16
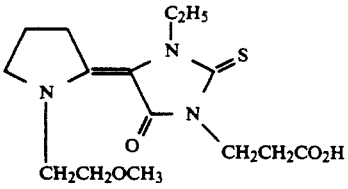
III-17
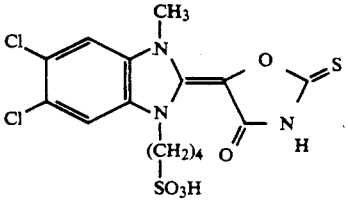
III-18
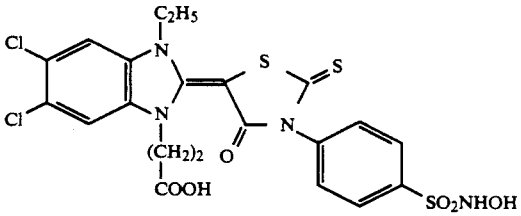
III-19
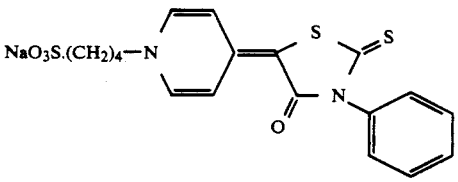
III-20
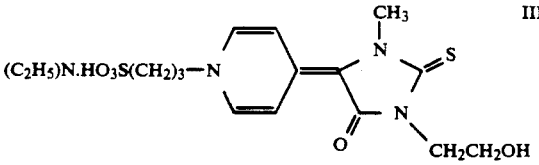
III-21
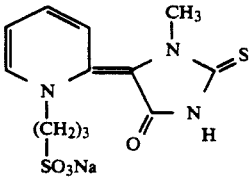
III-22
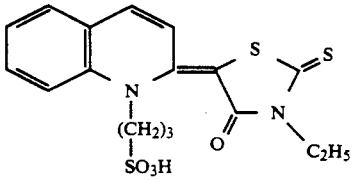

-continued

III-23

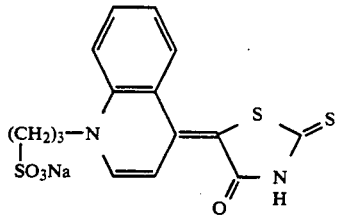

III-24

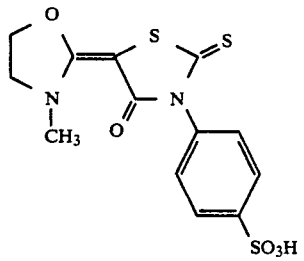

III-25

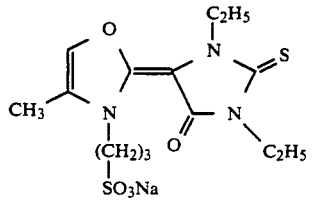

III-26

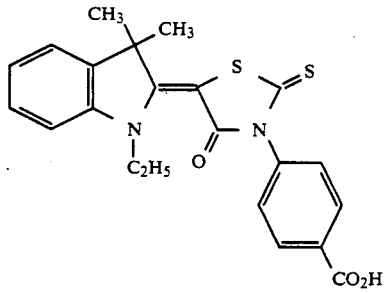

III-27

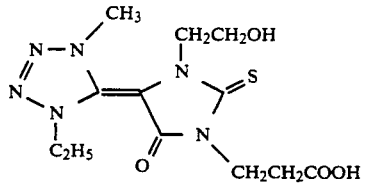

The compounds of formulae (II) and (III) are known compounds disclosed, e.g., in U.S. Pat. Nos. 2,852,385, 2,694,638, 3,615,635, 2,912,329, 3,364,031, 3,397,060, and 3,506,443, and British Patent 1,339,833. These compounds can easily be synthesized by one skilled in the art by referring to the disclosures of the above-cited patents or F. M. Hamer, *The Cyanine Dyes and Related Compounds*, Interscience Publishers, New York (1964). Compounds included under the formulae (II) and (III) but not specifically described above can also be synthesized by similar processes.

The compounds of formulae (II) and (III) can be incorporated into a light-sensitive material in the same manner as described with respect to the hydrazine derivatives of formula (I). The amounts to be added preferably ranges from $1\times10^{-6}$ to $1\times10^{-2}$ mol, and more preferably from $1\times10^{-5}$ to $1\times10^{-3}$ mol, per mol of silver halide.

High contrast emulsions or soft contrast emulsions which can be used in the light-sensitive materials containing the hydrazine derivative are desscribed below.

Silver halide in the photographic emulsions may have any halogen composition, such as silver chloride, silver chlorobromide, and silver iodobromide. Preferred silver halide is silver chloride or silver chlorobromide (preferably having a bromide content of not more than 5 mol%).

The silver halide emulsions may or may not be chemically sensitized. Primitive emulsions (chemically unsensitized emulsions) are preferred Chemical sensitization of silver halide emulsions is carried out by any of known techniques, such as sulfur sensitization, reduction sensitization, and noble metal sensitization, either alone or in combination thereof.

Sulfur sensitization is a preferred chemical sensitization means. It is effected by using a sulfur compound contained in gelatin as well as various sulfur compounds, e.g., thiosulfates, thioureas, and rhodanines.

Among the noble metal sensitization techniques, typical is gold sensitization using a gold compound, usually a gold complex. Complexes of other noble metals than gold, e.g., platinum, palladium and rhodium, may also be employed.

Reduction sensitization is conducted by using stannous salts, amines, formamidinesulfinic acids, silane compounds, and the like.

Silver halide grains preferably have a mean grain size of not more than 0.7 μm, and more preferably from 0.1 to 0.5 μm. The terminology "mean grain size" is a term commonly employed and easily understood in the art. More specifically, the term "grain size" means (i) a diameter of grains having a spherical or nearly spherical shape or (ii) (side length x $\sqrt{4/\pi}$) of grains having a cubic shape. A mean grain size is an algebraic or geometrical mean based on an average projected area of grains. For details of the method of obtaining a mean grain size, reference can be made in C. E. Mees and T. H. James, *The Theory of the Photographic Process*, 3rd Ed., pp. 36–43, MacMillan Publisher (1966).

Silver halide grains are not limited in shape and may have a plate-like form, a spherical form, a cubic form, a regular octahedral form, a tetradecahedral form, or any other forms. Grain size distribution is preferably narrow. In particular, a so-called mono-dispersed emulsion, in which at least 90%, desirably at least 95%, of the total number of grains fall within a size range of ±40% of a mean grain size, is preferred.

Modes of reaction between a soluble silver salt and a soluble halogen salt include a single jet process, a double jet process, and a combination thereof. A so-called reverse mixing method, in which silver halide grains are formed in the presence of excess silver ions, may be employed. Further, a so-called controlled double jet process, a modification of a double jet process, in which a pAg value of a liquid phase where grains are formed is maintained constant, can also be employed. According to the controlled double jet process, a silver halide emulsion having a regular crystal from and a nearly uniform grain size can be obtained.

With respect to silver halide emulsions and processes for preparing them, reference can be made in *Research Disclosure*, Vol. 176, Item 17643, pp. 22–23 (Dec., 1978) or references cited therein.

For prevention of fog during preparation, preservation or photographic processing of the light-sensitive material or for stabilization of photographic properties, various compounds can be introduced into the light-sensitive material of the present invention. Such compounds include azoles, such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzothiazoles, nitrobenzotriazoles, and mercaptotetrazoles (especially 1-phenyl-5-mercaptotetrazole); mercaptopyrimidines; mercaptotriazines; thioketo compounds, such as oxazolinethione; azaindenes, such as triazaindenes, tetraazaindenes (especially 4-hydroxysubstituted (1,3,3a,7)-tetraazaindenes), and pentaazaindenes; benzenethiosulfonic acids, benzenesulfinic acids, benzenesulfonic acid amides, and many other compounds known as antifoggants or stabilizers.

The photographic emulsion layers or light-insensitive hydrophilic colloidal layers may contain an organic or inorganic hardening agent, such as chromates (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine and bis(vinylsulfony)methyl ether, and N,N'-methylenebis[β-(vinylsulfonyl)propionamide]), active halogen compounds (e.g., 2,4-dichloro-6-hydroxy-s-triazine), and mucohalogenic acids (e.g., mucochloric acid and mucophenoxychloric acid), isoxazoles, dialdehyde starch, and 2-chloro-6-hydroxytriazinylated gelatin, either individually or in combination thereof.

The photographic emulsion layers and/or light-insensitive hydrophilic colloidal layers may further contain various known surface active agents for the purpose of coating aid, static charge prevention, improvement of slip properties, emulsification and dispersion aid, prevention of blocking, and improvement of photographic characteristics.

Gelatin is advantageously used as a binder or a protective colloid in photographic emulsions. Other hydrophilic colloids may also be employed. Examples of usable hydrophilic colloids are proteins, such as gelatin derivatives, graft polymers of gelatin with other high polymers, albumin, and casein; cellulose derivatives, e.g., hydroxyethyl cellulose, carboxymethyl cellulose, and cellulose sulfate; sugar derivatives, e.g., sodium alginate and starch derivatives; and various synthetic hydrophilic high-molecular substances, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. and copolymers comprising monomers constituting these homopolymers.

Included in gelatin are acid-processed gelatin as well as lime-processed gelatin. Hydrolysis products and enzymatic decomposition products of gelatin are also useful.

For the purpose of improving dimensional stability and the like, the photographic emulsions can contain a dispersion of a water-insoluble or sparingly water-soluble synthetic polymer. Examples of such a polymer include homopolymers or copolymers of an alkyl (meth)acrylate, an alkoxyalkyl (meth)acrylate, glycidyl (meth)acrylate, (meth)acrylamide, a vinyl ester (e.g., vinyl acetate), acrylonitrile, an olefin, and a styrene; and copolymers comprising these monomers and acrylic acid, methacrylic acid, an α,β-unsaturated dicarboxylic acid, a hydroxyalkyl (meth)acrylate, a sulfoalkyl (meth)acrylate, a styrenesulfonic acid, etc.

The silver halide photographic materials of the present invention can further contain other various additives, such as desensitizers, plasticizers, slip agents, development accelerators, oils, dyes, and the like. Specific examples of these additives as well as the above-mentioned additives are described in *Research Disclosure*, No. 176, pp. 22–31 (RD17643) (Dec., 1978).

Each of the emulsion layers and protective layers may be comprised of a single layer or two or more layers. In the latter case, an intermediate layer or the like layer may be provided between the layers.

The photographic emulsion layers or other layers are coated on one or both sides of a flexible support generally used in photographic light-sensitive materials. Useful flexible supports include films made of cellulose acetate, cellulose acetate butyrate, and synthetic high polymers, e.g., polystyrene and polyethylene terephthalate.

Conventional processing solutions, such as a developer, can be used in the present invention. More specifically, a developer to be used is selected from a PQ developer, an MQ developer, and a lith developer depending on the kind of the light-sensitive material to be processed, the system employed for obtaining a high contrast, the sensitivity of the light-sensitive material, and the like.

With respect to methods of development, reference can be made in *Research Disclosure*, Vol. 176, 17643, Items XIX, XX, and XXI, pp. 28–30 (Dec., 1978).

The silver halide light-sensitive material of the present invention can be processed with a stable developer to obtain ultrahigh contrast (having a gamma of 9 or higher), and there is no need to use conventional unstable lith developers (i.e., infectious developers). That is, the silver halide light sensitive material of the invention can be processed with a stable developer containing a sulfite ion as a preservative in a sufficient concentration (particularly 0.15 mol/l or more). The developer has a pH of 9.5 or higher, and preferably between 10.5 and 12.3.

A developing agent which can be used in the developer is not particularly restricted. In view of ease of obtaining satisfactory dot quality, the developer preferably contains dihydroxybenzenes. A combination of a dihydroxybenzene and a 1-phenyl-3-pyrazolidone or a combination of a dihydroxybenzene and a p-aminophenol is sometimes employed.

Examples of suitable dihydroxybenzene developing agents are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with hydroquinone being preferred.

Examples of suitable 1-phenyl-3-pyrazolidone developers are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihyiroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of suitable p-aminophenol developers are N-methyl-p-aminophenol, p-aminophenol, p-aminophenol, N-(β-hydroxyethyl)-p-aminophenol, N-(4-hydroxyphenyl)glycine, 2-methyl-p-aminophenol, and p-benzylaminophenol, with N-methyl-p-aminophenol being preferred.

The developing agent is preferably used in an amount of from 0.05 to 0.8 mol/l. In using a combination of a dihydroxybenzene and a 1-phenyl-3-pyrazolidone or a p-aminophenol, the former is preferably used in an amount of from 0.05 to 0.5 mol/l, and the latter is preferably used in an amount of not more than 0.06 mol/l.

Sulfites which can be used in the developer as preservative include sodium sulfite, potassium sulfite, lithium sulfite, ammonium sulfite, sodium bisulfite, potassium metabisulfite, and formaldehyde sodium bisulfite. The sulfite is preferably used in a concentration of 0.4 mol/l or higher, and particularly 0.5 mol/l or higher. The upper limit of the sulfite concentration is preferably 2.5 mol/l.

Alkali agents which can be used for pH adjustment of the developer include sodium hydroxide, potassium hydroxide, sodium carbonate, potassium carbonate, sodium tertiary phosphate, and phosphorus tertiary phosphate.

The light-sensitive material according to the present invention may additionally contain other various additives, such as development inhibitors, e.g., boric acid, borax, sodium bromide, potassium bromide, and potassium iodide; organic solvents, e.g., ethylene glycol, diethylene glycol, triethylene glycol, dimethylformamide, methyl cellosolve, hexylene glycol, ethanol, and methanol; antifoggants or black pepper inhibitors, including mercapto compounds, e.g., 1-phenyl-5-mercaptotetrazole and sodium 2-mercaptobenzimidazole-5-sulfonate, indazole compounds, e.g., 5-nitroindazole, and benzotriazole compounds, e.g., 5-methylbenzotriazole. If desired, the light-sensitive material may further contain toning agents, surface active agents, defoaming agents, water softeners, hardening agents, and amino compounds described in JP-A-56-106244.

The developer may contain the compound disclosed in JP-A-56-24347 as a silver stain inhibitor; the compound disclosed in JP-A-61-267759 as a dissolving aid; and the compound disclosed in JP-A-60-93433 as a pH buffer.

Development processing is preferably carried out at a temperature of from 18° to 50° C. for a period of from 15 to 60 seconds.

The present invention is now illustrated in greater detail by way of Examples, but it should be understood that the present invention is not deemed to be limited thereto.

In Examples, performance properties of samples were evaluated according to the following test methods.

Test Method

1. Evaluation of Image Quality in Enlargement

(1) Preparation of Original

A transmission image of a portrait composed of dots (original) and a step wedge having a stepwise varying dot percentage were prepared by using a monochromatic scanner "SCANART 30" (produced by Fuji Photo Film Co., Ltd.) and a light-sensitive material for exclusive use "SF-100" (produced by Fuji Photo Film Co., Ltd.). The screen line number was 150 lines/inch.

(2) Exposure

The original was set at a process camera "C-440" (produced by Dai-Nippon Screen K. K.) so as to obtain an equal enlargement ratio, and a sample under test was exposed to light emitted from a xenon lamp through the original, with an optical filter being placed between the original and the light source, if used.

The exposure amount was adjusted by varying exposure time in such a manner that the part of the step wedge having a dot percentage of 95% might be 5% on the sample.

(3) Development

The development was carried out at 34° C. for 30 seconds with a developer "GR-D1" and a fixer "GF-1" (both produced by Fuji Photo Film Co., Ltd.) by using an automatic development machine "FG-660F" (produced by Fuji Photo Film Co., Ltd.).

(4) Evaluation

The gradation reproducibility in the shadow of the sample [with the dot percentage in the highlight (small dot area) being adjusted by exposure control as described in (2) above] was rated in five scales (5: the best; 1: the worst).

2. Evaluation of Image Quality in Dot Copying

(1) Preparation of Original

A step wedge having a stepwise varying dot percentage was prepared by using a monochromatic scanner "SCANART 30" and an exclusive paper "SP-100 WP" (produced by Fuji Photo Film Co., Ltd.). The screen line number at the exposure was 150 lines/inch.

(2) Exposure

The original and a sample under test were set at a process camera "C-690" (Auto Companica) (manufactured by Dai-Nippon Screen K. K.), and light of a xenon lamp was irradiated to the reflex original, with an optical filter below being placed in front of the light source.

The exposure time was adjusted so that the part of the step wedge having a dot percentage of 80% might be 10% on the sample.

(3) Development

The development was carried ont in the same manner as described above for the evaluation of image quality.

(4) Evaluation

Gradation reproducibility in the shadow of the exposed sample [with the dot percentage in the highlight being adjusted to 10% by exposure time control as described in (2) above] was relatively evaluated, rating the best as 5 and the worst as 1.

3 Evaluation of Sensitivity

(1) Sensitivity in Enlargement

Sensitivity in enlargement was evaluated by determining an exposure time which provided a dot percentage of 5% on a sample in the area corresponding to the part of the step wedge used in the evaluation for image quality in enlargement having a dot percentage of 95%. The results obtained were relatively expressed taking the sensitivity of Test No. 1 as a standard (100).

(2) Sensitivity in Dot Copying

Sensitivity in dot copying was evaluated by determining an exposure time which provided a dot percentage of 10% on a sample in the area corresponding to the part of the step wedge used in the evaluation for image quality in dot copying having a dot percentage of 80%. The results obtained were relatively expressed taking the sensitivity of Test No. 1 as a standard (100).

EXAMPLE 1

Preparation of Silver Halide Emulsion

A mono-dispersed emulsion of cubic silver iodobromide grains having a mean grain size of 0.25 μm (coefficient of variation: 0.15; silver iodide content of 0.5 mol%; iodide distribution: uniform) was prepared by a controlled double jet process. During the grain formation, $K_3IrCl_6$ was added in an amount of $4\times10^{-7}$ mol per mol of silver.

After the emulsion was desalted by a flocculation method, $5\times10^{-4}$ mol/mol of Ag of Compound (V-1) as a sensitizing dye and $1\times10^{-3}$ mol/mol of Ag of a potassium iodide solution were added to the emulsion while maintaining at 50° C. After allowing the emulsion to stand for 15 minutes, the temperature was decreased.

To the emulsion were added, as stabilizers, 4-hydroxy6-methyl-1,3,3a,7-tetraazaindene, 5-methylbenzotriazole, and Compounds (a) and (b) shown below each in an amount of 5 mg/m².

Compound (a):

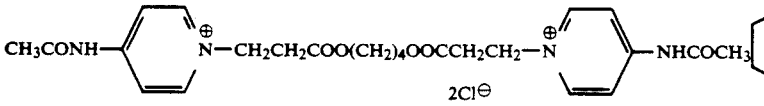

Compound (b):

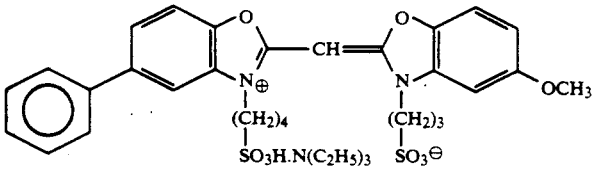

Hydrazine Compound (I-19) was added to the emulsion in an amount shown in Table 1 below. Further, 75 mg/m² of polyethylene glycol having an average molecular weight of 600, 30% by weight (on a solid basis), based on gelatin, of a polyethyl acrylate dispersion, and 1,3-divinylsulfonyl-2-propanol (as a hardening agent) were added to the emulsion. The resulting coating composition was coated on a polyethylene terephthalate film to a silver coverage of 3.5 g/m² to form an emulsion layer.

A composition comprising 1.2 g/m² of gelatin, 40 mg/m² of an amorphous $SiO_2$ matting agent having a particle size of about 3 μm, 0.1 g/m² of colloidal silica, 100 mg/m² of polyacrylamide, 200 mg/m² of hydroquinone, a silicon oil, and, as surface active agents, a fluorine-containing surface active agent of formula:

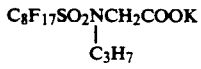

and sodium dodecylbenzenesulfonate was simultaneously coated on the emulsion layer to form a protective layer.

A backing layer having the following composition was coated on the back of the polyethylene terephthalate film support.

| Backing Layer Composition: | |
|---|---|
| Gelatin | 4 g/m² |
| Matting agent (polymethyl methacrylate having a particle size of 3.0 to 4.0 μm) | 10 mg/m² |
| Polyethyl acrylate latex | 2 g/m² |
| Surface active agent (sodium p-dodecylbenzene sulfonate) | 40 mg/m² |
| Fluorine-containing surface active agent: | 5 mg/m² |
| $C_8F_{17}SO_2N(C_3H_7)CH_2COOK$ | |
| Gelatin hardening agent: | 110 mg/m² |
| $CH_2{=}CHSO_2CH_2CONH(CH_2)_2CH_2{=}CHSO_2CH_2CONH$ | |
| Dye: a mixture of: | |
| Dye (a) | 50 mg/m² |
| Dye (b) | 100 mg/m² |
| Dye (c) | 50 mg/m² |

Dye (a)

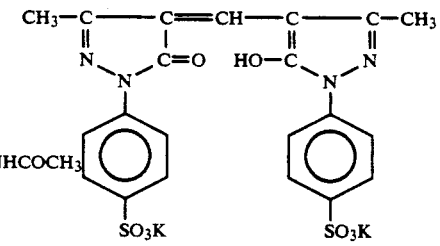

Dye (b)

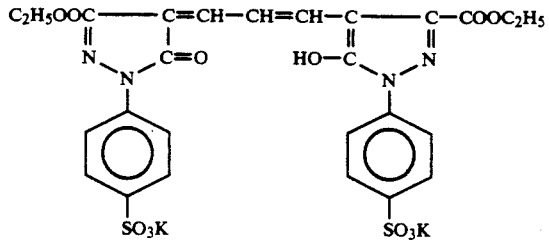

-continued

| Backing Layer Composition: |
|---|
| Dye (c) |

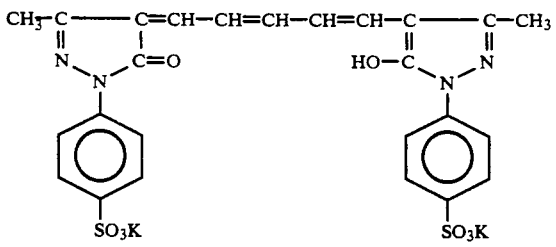

The thus prepared light-sensitive materials were designated Samples 1 to 3. Gamma values of Samples 1 to 3 are shown in Table 1 below.

TABLE 1

| Sample No. | Amount of (I-19) Added (mol/mol-Ag) | γ |
|---|---|---|
| 1 | $5 \times 10^{-4}$ | 15.2 |
| 2 | $4 \times 10^{-4}$ | 12.1 |
| 3 | $3 \times 10^{-4}$ | 8.0 |

Each of Samples 1 to 3 was exposed to light of a xenon lamp through each of optical filters shown in Table 2 below and developed as described above. The performance properties in enlargement were evaluated according to the test methods described above. The results obtained are shown in Table 2. Characteristics of the filters used in testing are shown in FIG. 1.

TABLE 2

| | | Enlargement | | | |
|---|---|---|---|---|---|
| Test No. | Sample No. | Filter Used | Sensitivity | Image Quality | Remark |
| 1 | 1 | — | 100 | 2 | Comparison |
| 2 | 1 | SC-38 | 100 | 4 | Invention |
| 3 | 1 | SC-41 | 100 | 5 | " |
| 4 | 1 | SC-46 | 95 | 5 | " |
| 5 | 1 | SC-48 | 74 | 5 | " |
| 6 | 1 | SC-50 | 49 | 5 | " |
| 7 | 1 | SC-52 | 40 | 5 | " |
| 8 | 1 | EK Sheeting Yellow | 66 | 5 | " |
| 9 | 2 | — | 98 | 1 | Comparison |
| 10 | 2 | SC-38 | 98 | 4 | Invention |
| 11 | 2 | SC-46 | 91 | 4 | " |
| 12 | 3 | — | 91 | 1 | Comparison |
| 13 | 3 | SC-38 | 91 | 2 | Invention |
| 14 | 3 | SC-46 | 85 | 2 | " |

As is apparent from Table 2, Test Nos. 2 to 4 according to the image formation system of the present invention exhibit marked improvement in image quality without being accompanied by substantial reduction in sensitivity.

EXAMPLE 2

A mono-dispersed emulsion of cubic silver chloroiodobromide having a grain size of 0.22 μm (coefficient of variation: 0.13; silver iodide content: 0.1 mol%; silver bromide content: 30 mol%; iodide-rich grain surface) was prepared by a double jet process. The grain formation was conducted in the presence of $5\times10^{-6}$ mol/mol-Ag of $(NH_4)_3RhCl_6$ and $5\times10^{-7}$ mol/mol-Ag of $K_3IrCl_6$. After desalting in a usual manner, the emulsion was subjected to gold-sulfur sensitization using sodium thiosulfate and potassium chloroaurate.

To the emulsion were added $3\times10^{-4}$ mol/mol-Ag of Compound (V-7) as a sensitizing dye and $2\times10^{-4}$ mol/mol-Ag of Hydrazine Compound (I-5). To the emulsion were further added 1.5 g of 4-hydroxy-6-methyl-1,3,3a,7-tetraazaindene, 2 g of chlorohydroquinone, 2 g of resorcin aldoxime, and 0.1 g of 1-phenyl-5-mercaptotetrazole as stabilizers each per mol of Ag. After addition of a polyethyl acrylate dispersion in an amount of 30% by weight (on a solid basis) based on gelatin and, as a hardening agent, 1,3-divinylsulfonyl-2-propanol, the resulting coating composition was coated on a polyethylene terephthalate to a silver coverage of 3.5 g/m$^2$ to form an emulsion layer. A protective layer and a backing layer were also formed in the same manner as in Example 1.

The resulting sample was tested in the same manner as in Example 1, and the results obtained are shown in Table 3 below. As is apparent from the results of Table 3, Test Nos. 2 to 4 exhibit marked improvement in suitability in enlargement and dot copying without being accompanied by substantial reduction in sensitivity.

TABLE 3

| | | Enlargement | | Copy Dot | | |
|---|---|---|---|---|---|---|
| Test No. | Filter Used | Sensitivity | Image Quality | Sensitivity | Image Quality | Remarks |
| 1 | — | 100 | 2 | 100 | 3 | Comparison |
| 2 | SC-38 | 100 | 4 | 100 | 4 | Invention |
| 3 | SC-41 | 100 | 5 | 98 | 4 | Invention |
| 4 | SC-46 | 95 | 5 | 95 | 5 | Invention |
| 5 | SC-48 | 52 | 5 | 51 | 5 | Comparison |
| 6 | SC-50 | 41 | 5 | 40 | 5 | Comparison |

EXAMPLE 3

Each of Samples 1 to 3 as prepared in Example 1 was exposed to light and processed in the same manner as in Test Nos. 1 to 14, except for using a developer having the following formulation. The results of the tests were substantially equal to those shown in Table 2 .

| Developer Formulation: | |
|---|---|
| Hydroquinone | 50.0 g |
| N-Methyl-p-aminophenol | 0.3 g |
| Sodium hydroxide | 18.0 g |
| 5-Sulfosalicylic acid | 30.0 g |
| Boric acid | 20.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| 6-Dimethylamino-1-hexanol | 4.0 g |
| Sodium toluenesulfonate | 15.0 g |
| Water to make | 1 l |
| pH (adjusted with potassium hydroxide) | pH 11.7 |

EXAMPLE 4

Sample Nos. 4 to 14 were prepared in the same manner as for Sample 1 of Example 1, except for further adding each of dye compounds shown in Table 4 below to the emulsion, instead of using the filter.

Each of the samples was tested in the same manner as in Example 1, except for using no optical filter at the time of exposure, and the results obtained are shown in Table 4.

TABLE 4

| Sample No. | Dye Compound Kind | Amount (mg/m²) | $\lambda_{max}$ (nm) | Enlargement Image Quality | Enlargement Sensitivity | Copy Dot Image Quality | Copy Dot Sensitivity | Remark |
|---|---|---|---|---|---|---|---|---|
| 4 | — | — | — | 2 | 100 | 3 | 100 | Comparison |
| 5 | D-23 | 50 | 363 | 3 | 100 | 4 | 100 | Invention |
| 6 | " | 100 | " | 4.5 | 100 | 5 | 100 | " |
| 7 | " | 200 | " | 5 | 100 | 5 | 100 | " |
| 8 | " | 400 | " | 5 | 95 | 5 | 95 | " |
| 9 | D-19 | 200 | 380 | 5 | 100 | 5 | 100 | " |
| 10 | D-20 | 200 | 399 | 5 | 95 | 5 | 95 | " |
| 11 | D-24 | 200 | 333 | 4 | 100 | 5 | 100 | " |
| 12 | (a) | 200 | 430 | 5 | 70 | 5 | 70 | Comparison |
| 13 | (b) | 100 | 458 | 3 | 55 | 3 | 55 | " |
| 14 | (c) | 100 | 480 | 2 | 40 | 2 | 40 | " |

The Dye Compounds (a), (b) and (c) in Table 4 above are shown below:

Comparative Compound (a):

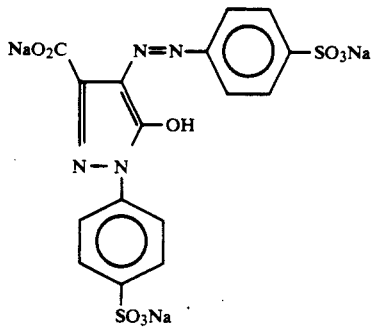

Comparative Compound (b):

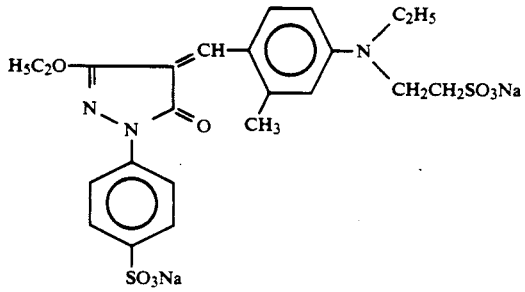

Comparative Compound (c):

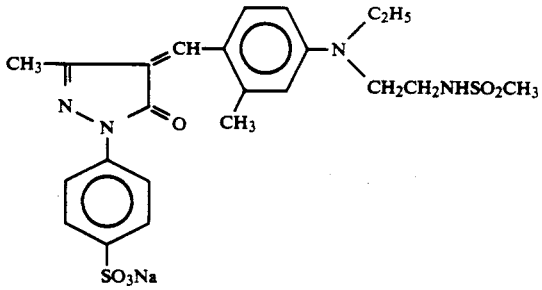

It can be seen from Table 4 that Sample Nos. 5 to 11 according to the present invention exhibit significantly improved image quality without undergoing reduction in sensitivity.

EXAMPLE 5

Samples were prepared in the same manner as in Example 4, except for adding $3\times10^{-4}$ mol/mol-Ag of Compound (V-7) as a sensitizing dye in place of Compound (V-1) and tested in the same manner as in Example 4. The results obtained were similar to those of Example 4.

EXAMPLE 6

A mono-dispersed emulsion of cubic silver chloroiodobromide having a grain size of 0.22 μm (percent variation: 13%; silver iodide content: 0.1 mol%; silver bromide content: 30 mol%; iodide-rich grain surface) was prepared by a double jet process. The grain formation was conducted in the presence of $5\times10^{-6}$ mol/mol-Ag of $(NH_4)_3RhCl_6$ and $5\times10^{-7}$ mol/mol-Ag of $K_3IrCl_6$. After desalting in a usual manner, the emulsion was subjected to gold-sulfur sensitization using sodium thiosulfate and potassium chloroaurate.

To the emulsion were added $3\times10^{-4}$ mol/mol-Ag of Compound (V-7) as a sensitizing dye and $2\times10^{-4}$ mol/mol-Ag of Hydrazine Compound (I-5). To the emulsion was further added a dye compound as shown in Table 5 below. To the emulsion were furthermore added 1.5 g of 4-hydroxy-6-methyl-1,3,3a,7-tetraazaindene, 2 g of chlorohydroquinone, 2 g of resorcin aldoxime, and 0.1 g of 1-phenyl-5-mercaptotetrazole as stabilizers each per mol of Ag. After addition of a polyethyl acrylate dispersion in an amount of 30% by weight (on a solid basis) based on gelatin and, as a hardening agent, 1,3-divinylsulfonyl-2-propanol, the resulting coating composition was coated on a polyethylene terephthalate to a silver coverage of 3.5 g/m² to form an emulsion layer. A protective layer and a backing layer were also formed in the same manner as in Example 1.

The resulting sample was tested in the same manner as in Example 4, and the results obtained are shown in Table 5 below. It can be seen from the results of Table 5 that the effects of the present invention are manifested when in using a silver chloroiodobromide emulsion as well.

TABLE 5

| Sample No. | Dye Compound Kind | Amount (mg/m²) | $\lambda_{max}$ (nm) | Enlargement Image Quality | Enlargement Sensitivity | Copy Dot Image Quality | Copy Dot Sensitivity | Remark |
|---|---|---|---|---|---|---|---|---|
| 12 | — | — | — | 3 | 100 | 3 | 100 | Comparison |
| 13 | D-23 | 50 | 363 | 4 | 100 | 4 | 100 | Invention |
| 14 | " | 100 | " | 4.5 | 100 | 5 | 100 | " |

TABLE 5-continued

| Sample No. | Dye Compound Kind | Amount (mg/m²) | $\lambda_{max}$ (nm) | Enlargement Image Quality | Enlargement Sensitivity | Copy Dot Image Quality | Copy Dot Sensitivity | Remark |
|---|---|---|---|---|---|---|---|---|
| 15 | " | 200 | " | 5 | 100 | 5 | 100 | " |
| 16 | " | 400 | " | 5 | 90 | 5 | 90 | " |
| 17 | D-19 | 200 | 380 | 5 | 100 | 5 | 100 | " |
| 18 | D-20 | 200 | 399 | 5 | 95 | 5 | 95 | " |
| 19 | D-24 | 200 | 333 | 4 | 100 | 5 | 100 | " |
| 20 | (a) | 200 | 430 | 5 | 70 | 5 | 70 | Comparison |
| 21 | (b) | 100 | 458 | 3 | 55 | 3 | 55 | " |
| 22 | (c) | 100 | 480 | 2 | 40 | 2 | 40 | " |

EXAMPLE 7

Samples 23 to 26 were prepared in the same manner as in Example 4, except for adding no dye compound to the emulsion layer and coating a protective layer comprising 1.2 g/m² of gelatin, 40 mg/m² of an amorphous $SiO_2$ matting agent having a particle size of about 3 μm, 0.1 g/m² of methanol silica, a silicone oil, Compounds (F) and (G) shown below as coating aids, and a dye compound as shown in Table 6 below.

Compound (F):

$$C_8F_{17}SO_2N(C_3H_7)CH_2COOK$$

Compound (G):

$$C_{11}H_{23}CONH(CH_2)_3N^+(CH_3)_2-(CH_2)_4SO_3^-$$

TABLE 6

| Sample No. | Dye Compound Kind | Amount (mg/m²) | $\lambda_{max}$ (nm) | Enlargement Image Quality | Enlargement Sensitivity | Copy Dot Image Quality | Copy Dot Sensitivity | Remark |
|---|---|---|---|---|---|---|---|---|
| 23 | — | — | — | 2 | 100 | 2 | 100 | Comparison |
| 24 | D-28 | 50 | 360 | 5 | 100 | 5 | 100 | Invention |
| 25 | " | 100 | " | 5 | 95 | 5 | 95 | " |
| 26 | D-34 | 50 | 355 | 5 | 95 | 5 | 95 | " |

It can be seen from the results of Table 6 that the effects of the dye compounds according to the present invention can be markedly produced even at low amounts.

EXAMPLE 8

Sample Nos. 4 to 14 as prepared in Example 4 were exposed and processed in the same manner as in Example 4, except for using each of Developers (1), (2), and (3) shown below. When the processed samples were evaluated in the same manner as in Example 4, the results obtained were substantially equal to those of Example 4.

| Developer Formulation: | (1) (g) | (2) (g) | (3) (g) |
|---|---|---|---|
| Hydroquinone | 50.0 | 50.0 | 50.0 |
| N-Methyl-p-aminophenol | 0.3 | 0.3 | — |
| 4-Methyl-4-hydroxymethyl-1-phenyl-3-pyrazolidone | — | — | 0.1 |
| Sodium hydroxide | 18.0 | 18.0 | 18.0 |
| 5-Sulfosalicylic acid | 30.0 | 30.0 | 30.0 |
| Boric acid | 20.0 | 20.0 | 20.0 |
| Potassium sulfite | 110.0 | 110.0 | 110.0 |
| Disodium ethylenediaminetetraacetate | 1.0 | 1.0 | 1.0 |
| Potassium bromide | 10.0 | 10.0 | 10.0 |
| 5-Methylbenzotriazole | 0.4 | 0.4 | 0.4 |
| 2-Mercaptobenzimidazole-5-sulfonic acid | 0.3 | 0.3 | 0.3 |
| Sodium 3-(5-mercaptotetrazole)benzenesulfonate | 0.2 | 0.2 | 0.2 |
| N-n-Butyldiethanolamine | — | 15.0 | — |
| 6-Dimethylamino-1-hexanol | 4.0 | — | 4.0 |
| Sodium toluenesulfonate | 15.0 | 15.0 | 15.0 |
| Water to make | 1 l | 1 l | 1 l |
| pH (adjusted with potassium hydroxide) | 11.7 | 11.7 | 11.7 |

EXAMPLE 9

Preparation of Silver Halide Emulsion

A mono-dispersed emulsion of cubic silver iodobromide grains having a mean grain size of 0.25 μm (percent variation: 12%; silver iodide content of 0.5 mol%; iodide distribution: uniform) was prepared by a controlled double jet process. During the grain formation, $K_3IrCl_6$ was added in an amount of $4\times10^{-7}$ mol per mol of silver.

After the emulsion was desalted by a flocculation method, $5\times10^{-4}$ mol/mol-Ag of the dye (V-1) (sodium 5,5'-dichloro-3,3,-di (3-sulfopropyl)-9-ethyl-oxacarbocyanine) as a sensitizing dye and $1\times10^{-3}$ mol/mol-Ag of a potassium iodide solution were added to the emulsion while maintaining at 50° C. After allowing the emulsion to stand for 15 minutes, the temperature was decreased.

To the emulsion were added, as stabilizers, 4-hydroxy-6-methyl-1,3,3a,7-tetraazaindene, 5-methylbenzotriazole, and a compound shown below each in an amount of 5 mg/m².

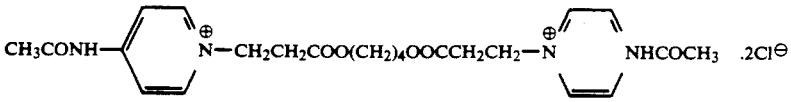

To the emulsion was added $5\times10^{-4}$ mol/mol-Ag of Hydrazine Compound (I-19) was added. Further, a dye, a compound of formula (II), and a compound of formula (III) were added thereto each in an amount of $3\times10^{-4}$ mol/mol-Ag as shown in Table 7 below. Furthermore, 75 mg/m$^2$ of polyethylene glycol having an average molecular weight of 600, 30% by weight (on a solid basis), based on gelatin, of a polyethyl acrylate dispersion, and 1,3-divinylsulfonyl-2-propanol (as a hardening agent) were added to the emulsion. The resulting coating composition was coated on a polyethylene terephthalate film to a silver coverage of 3.5 g/m$^2$ to form an emulsion layer.

A composition comprising 1.2 g/m$^2$ of gelatin, 40 mg/m$^2$ of an amorphous $SiO_2$ matting agent having a particle size of about 3 μm, 0.1 g/m$^2$ of methanol silica, 100 mg/m$^2$ of polyacrylamide, 200 mg/m$^2$ of hydroquinone, a silicon oil, and, as coating aids, a fluorine-containing surface active agent of formula:

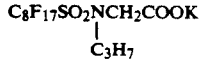

and sodium dodecylbenzenesulfonate was simultaneously coated on the emulsion layer to form a protective layer.

A backing layer was formed in the same manner as in Example 1.

Each of the resulting samples (Sample Nos. 27 to 42) was exposed and processed in the same manner as in Example 1, and tested in the same manner as in Example 4. Further, the sample was evaluated for black pepper according to the following test method.

Evaluation of Black Pepper

Black spots (black pepper) appearing in the unexposed area of the sample were evaluated in size and number under a 25X magnifier. Evaluations were made on 5 scales, rating samples suffering from no black pepper at all as 5 and samples the most seriously suffering from black pepper as 1.

The results of these evaluations are shown in Table 7. It can be seen that the samples according to the present invention achieve significant improvement on image quality without suffering from reduction in sensitivity.

TABLE 7

| Sample No. | Dye Compound Kind | Amount (mg/m$^2$) | $\lambda_{max}$ (nm) | Compound (II) | Compound (III) | Enlargement Image Quality | Enlargement Sensitivity | Copy Dot Image Quality | Copy Dot Sensitivity | Black Pepper | $D_{max}$ | Remark |
|---|---|---|---|---|---|---|---|---|---|---|---|---|
| 27 | — | — | — | — | — | 2 | 100 | 3 | 100 | 2 | 4.3 | Comparison |
| 28 | — | — | — | II-6 | — | 1 | 100 | 2 | 100 | 5 | 5.0 | " |
| 29 | D-23 | 50 | 363 | " | — | 3 | 100 | 4 | 100 | 5 | 5.0 | Invention |
| 30 | " | 100 | " | " | — | 4.5 | 100 | 5 | 100 | 5 | 5.0 | " |
| 31 | " | 200 | " | " | — | 5 | 100 | 5 | 100 | 5 | 4.9 | " |
| 32 | " | " | " | II-15 | — | 5 | 100 | 5 | 100 | 5 | 4.8 | " |
| 33 | " | " | " | — | III-19 | 5 | 100 | 5 | 100 | 3 | 5.0 | " |
| 34 | " | " | " | — | III-13 | 5 | 100 | 5 | 100 | 3 | 5.2 | " |
| 35 | " | " | " | — | — | 5 | 100 | 5 | 100 | 2 | 4.1 | Comparison |
| 36 | D-19 | " | 380 | II-6 | — | 5 | 95 | 5 | 95 | 5 | 4.9 | Invention |
| 37 | " | " | " | — | III-19 | 5 | 95 | 5 | 95 | 3 | 4.9 | " |
| 38 | D-20 | " | 399 | II-6 | — | 5 | 95 | 5 | 95 | 5 | 5.0 | " |
| 39 | D-24 | " | 333 | " | — | 5 | 100 | 5 | 100 | 5 | 4.9 | " |
| 40 | (a) | " | 430 | " | — | 5 | 70 | 5 | 70 | 5 | 4.6 | Comparison |
| 41 | (b) | 100 | 458 | " | — | 3 | 55 | 3 | 55 | 5 | 4.8 | " |
| 42 | (c) | " | 480 | " | — | 2 | 40 | 2 | 40 | 5 | 4.7 | " |

EXAMPLE 10

The same procedure as in Example 9 was repeated, except for using $3\times10^{-4}$ mol/mol-Ag of sodium 1-(2-hydroxyethoxyethyl)-3-(pyridin-2-yl)-5-[(3-sulfobutyl-5-chloro-2-benzoxazolinidene)- ethylidene]-2-thiohydantoin as a sensitizing dye. The results of testing were substantially equal to those obtained in Example 9.

EXAMPLE 11

A mono-dispersed emulsion of cubic silver chloroiodobromide having a grain size of 0.22 μm (coefficient of variation: 0.13; silver iodide content: 0.1 mol%; silver bromide content: 30 mol%; iodide-rich grain surface) was prepared by a double jet process. The grain formation was conducted in the presence of $5\times10^{-6}$ mol/mol-Ag of $(NH_4)_3RhCl_6$ and $5\times10^{-7}$ mol/mol-Ag of $K_3IrCl_6$. After desalting in a usual manner, the emulsion was subjected to gold-sulfur sensitization using sodium thiosulfate and potassium chloroaurate.

To the emulsion were added $3\times10^{-4}$ mol/mol-Ag of the same sensitizing dye as used in Example 10 and $2\times10^{-4}$ mol/mol-Ag of Hydrazine Compound (I-5). To the emulsion was further added a dye compound as shown in Table 8 below. To the emulsion were furthermore added 1.5 g of 4-hydroxy-6-methyl-1,3,3a,7-tetraazaindene, 2 g of chlorohydroquinone, 2 g of resorcin aldoxime, and 0.1 g of 1-phenyl-5-mercaptotetrazole as stabilizers each per mol of Ag. After addition of a polyethyl acrylate dispersion in an amount of 30% by weight (on a solid basis) based on gelatin and, as a hardening agent, 1,3-divinylsulfonyl-2-propanol, the resulting coating composition was coated on a polyethylene terephthalate to a silver coverage of 3.5 g/m$^2$ to form an emulsion layer. A protective layer and a backing layer were also formed in the same manner as in Example 9.

The resulting sample was tested in the same manner as in Example 9, and the results obtained are shown in Table 8 below. It can be seen from the results of Table 8 that the effects of the present invention are manifested when in using a silver chloroiodobromide emulsion as well.

TABLE 8

| Sample No. | Dye Compound Kind | Amount (mg/m²) | $\lambda_{max}$ (nm) | Compound (II) | Compound (III) | Enlargement Image Quality | Enlargement Sensitivity | Copy Dot Image Quality | Copy Dot Sensitivity | Black Pepper | $D_{max}$ | Remark |
|---|---|---|---|---|---|---|---|---|---|---|---|---|
| 43 | — | — | — | — | — | 2 | 100 | 3 | 100 | 1 | 4.5 | Comparison |
| 44 | — | — | — | II-6 | — | 1 | 100 | 2 | 100 | 4 | 5.2 | " |
| 45 | D-23 | 50 | 363 | " | — | 3 | 100 | 4 | 100 | 5 | 5.3 | Invention |
| 46 | " | 100 | " | " | — | 4.5 | 100 | 5 | 100 | 5 | 5.1 | " |
| 47 | " | 200 | " | " | — | 5 | 100 | 5 | 100 | 5 | 5.0 | " |
| 48 | " | " | " | II-15 | — | 5 | 100 | 5 | 100 | 5 | 4.9 | " |
| 49 | " | " | " | — | III-19 | 5 | 100 | 5 | 100 | 3 | 5.3 | " |
| 50 | " | " | " | — | III-13 | 5 | 100 | 5 | 100 | 3 | 5.1 | " |
| 51 | " | " | " | — | — | 5 | 100 | 5 | 100 | 2 | 4.4 | Comparison |
| 52 | D-19 | " | 380 | II-6 | — | 5 | 95 | 5 | 95 | 5 | 5.0 | Invention |
| 53 | " | " | " | — | III-19 | 5 | 95 | 5 | 95 | 4 | 5.0 | " |
| 54 | D-20 | " | 399 | II-6 | — | 5 | 95 | 5 | 95 | 5 | 5.2 | " |
| 55 | D-24 | " | 333 | " | — | 5 | 100 | 5 | 100 | 5 | 4.9 | " |
| 56 | (a) | " | 430 | " | — | 5 | 70 | 5 | 70 | 5 | 4.6 | Comparison |
| 57 | (b) | 100 | 458 | " | — | 3 | 55 | 3 | 55 | 5 | 4.9 | " |
| 58 | (c) | " | 480 | " | — | 2 | 40 | 2 | 40 | 5 | 4.8 | " |

EXAMPLE 12

The same procedure as in Example 9 was repeated, except for adding no dye to the emulsion layer and coating the protective layer using a composition comprising 1.2 g/m² of gelatin, 40 mg/m² of an amorphous $SiO_2$ matting agent having a particle size of about 3 μm, 0.1 g/m² of methanol silica, a silicone oil, Compounds (F) and (G) as used in Example 7, and dye compound as shown in Table 9 below. The results of testing are shown in Table 9. It is confirmed from Table 9 that the effects of the dye compounds according to the present invention can be produced even at low amounts.

TABLE 9

| Sample No. | Dye Compound Kind | Amount (mg/m²) | $\lambda_{max}$ (nm) | Compound (II) | Enlargement Image Quality | Enlargement Sensitivity | Copy Dot Image Quality | Copy Dot Sensitivity | Remark |
|---|---|---|---|---|---|---|---|---|---|
| 59 | — | — | — | II-6 | 2 | 100 | 2 | 100 | Comparison |
| 60 | D-28 | 50 | 360 | " | 5 | 100 | 5 | 100 | Invention |
| 61 | " | 100 | " | " | 5 | 100 | 5 | 95 | " |
| 62 | D-34 | 50 | 355 | " | 5 | 95 | 5 | 95 | " |

EXAMPLE 13

Samples Nos. 27 to 37 as prepared in Example 9 were processed in the same manner as in Example 9, except for using each of Developers (1) to (3) as used in Example 8. The test results obtained were substantially equal to those obtained in Example 9.

While the invention has been described in detail and with reference to specific embodiments thereof, it will be apparent to one skilled in the art that various changes and modifications can be made therein without departing from the spirit and scope thereof.

What is claimed is:

1. A method for forming an image which comprises (i) imagewise exposing a negatively working silver halide photographic material comprising a support having thereon at least one silver halide emulsion layer to light having a wavelength of from 460 to 600 nm to form an image with light from that wavelength region, wherein the light first passes through an ultraviolet absorbing optical filter which does not substantially transmit light of 360 nm or less, said emulsion layer containing at least one sensitizing dye having an absorption maximum ($\lambda_{max}$) between 450 nm and 580 nm and being present in an amount of from $1\times10^{-6}$ to $1\times10^{-1}$ mol per mol of silver, and said emulsion layer or other hydrophilic colloid layer containing at least one hydrazine derivative represented by formula (I):

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group; $R_2$ represents a hydrogen atom, an alkyl group, an aryl group, an alkoxyl group, an aryloxy group, an amino group, a carbamoyl group, or an oxycarbonyl group; $G_1$ represents a carbonyl group, a sulfonyl group, a sulfoxy group, a $$-\overset{\overset{O}{\|}}{\underset{\underset{R_2}{|}}{P}}-$$

group (wherein $R_2$ is an defined above), or an iminomethylene group; $A_1$ and $A_2$ each represents a hydrogen atom, or one of $A_1$ and $A_2$ represents a hydrogen atom and the other represents a substituted or unsubstituted alkylsulfonyl group, a substituted or unsubstituted arylsulfonyl group, or a substituted or unsubstituted acyl group, and (ii) developing the image-wise exposed photographic material to form an image.

2. A method for forming an image as claimed in claim 1, wherein $R_1$ or $R_2$ said hydrazine derivative represented by formula (I) contains a group accelerating adsorption to the surfaces of silver halide grains.

3. A method for forming an image as claimed in claim 1, wherein said hydrazine derivative represented by formula (I) contains a ballast group having at least 8 carbon atoms selected from the group consisting of an alkyl group, an alkoxyl group, a phenyl group, and a phenoxy group.

4. A method for forming an image as claimed in claim 1, wherein said optical filter has a percent transmission of not more than 10% to light having a wavelength of 360 nm or less and a percent transmission of not less than 80% to light having a wavelength of from 460 to 600 nm.

5. A method for forming an image as claimed in claim 1, wherein said imagewise exposing is carried out by using a halogen lamp, a xenon lamp, or a fluorescent lamp as a light source.

6. A negatively working silver halide photographic material comprising a support having thereon at least one silver halide emulsion layer, said emulsion layer containing at least one sensitizing dye having an absorption maximum ($\lambda_{max}$) at a wavelength between 450 nm and 580 nm, and said emulsion layer or other hydrophilic colloidal layer containing (1) at least one hydrazine derivative and (2) a dye having an absorption maximum at a wavelength between 300 to 420 nm; wherein said photographic material further contains at least one compound selected from the group consisting of compounds represented by formula (II):

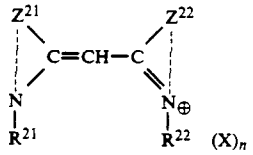

(II)

wherein $Z^{21}$ and $Z^{22}$ each represents a non-metallic atom group necessary to form a thiazole nucleus, a thiazoline nucleus, an oxazole nucleus,. a selenazole nucleus, a selenazoline nucleus, a pyridine nucleus, or a quinoline nucleus; $R^{21}$ and $R^{22}$ each represents an alkyl group; X represents a charge balancing counter ion; and n represent 0 or 1, and compounds represented by formula (III):

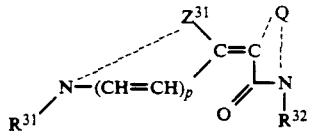

(III)

wherein $R^{31}$ represents a non-metallic atom group necessary to form a thiazoline nucleus, a thiazolidine nucleus, a selenazoline nucleus, a selenazolidine nucleus, a pyrrolidine nucleus, a dihydropyridine nucleus, an oxazoline nucleus, an oxazolidine nucleus, an imidazoline nucleus, an indoline nucleus, or a tetrazoline nucleus; Q represents a non-metallic atom group necessary to form a rhodanine nucleus, a 2-thiooxazoline-2,4-dione nucleus, a 2-thioselenazoline-2,4-dione nucleus, a 2-thiohydantoin nucleus, or a barbituric acid nucleus; $R^{31}$ and $R^{32}$ each represents a hydrogen atom, an alkyl group, or an aryl group; and p represents 0 or 1.

7. A negatively working silver halide photographic material as claimed in claim 6, wherein said dye having an absorption maximum at a wavelength between 300 to 420 nm is a compound selected from the compounds represented by formula (D-1):

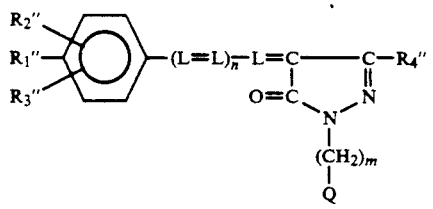

(D-1)

wherein $R_1''$ represents —OX or

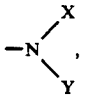

wherein X and Y each represents a hydrogen atom, an unsubstituted alkyl group, a cyanoalkyl group, a carboxyalkyl group, a sulfoalkyl group, or a hydroxyalkyl group, or a sodium or potassium salt thereof; $R_2''$ and $R_3''$ each represents a hydrogen atom, a halogen atom, an alkyl group, an alkoxyl group, an alkylthio group or —OX (wherein X is as defined above); Q represents a phenyl group substituted with at least one of a halogen atom, a carboxyl group, a sulfo group, and a sulfoalkyl group, and a sodium or potassium salt thereof, a sulfoalkyl group, a sulfoalkoxyalkyl group, or a sulfoalkylthioalkyl group; L represents a substituted or unsubstituted methine group; $R_4''$ represents an alkyl group, a carboxyl group, an alkyloxycarbonyl group, an unsubstituted amino group, or an acyl-substituted amino group; m represents 1 or 2; and n represents 0 or 1, the compounds represented by formula (D-2):

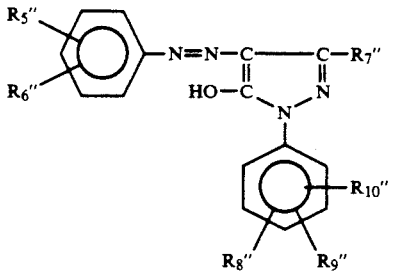

(D-2)

wherein $R_5''$ $R_6''$, $R_8''$, $R_9''$, and $R_{10}''$ each represents a hydrogen atom, a halogen atom, an alkyl group, a hydroxyl group, an alkoxy group, an amino group, an acylamino group, a carboxyl group, or a sulfo group, or a sodium or potassium salt thereof; and $R_7''$ represents an alkyl group or a carboxyl group, the compounds represented by formula (D-3):

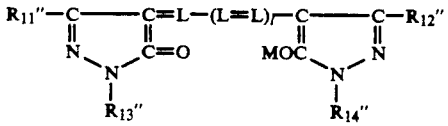

(D-3)

wherein $R_{11}''$ and $R_{12}''$ each represents an alkyl group, an aryl group, an alkoxycarbonyl group, or a carboxyl group; $R_{13}''$ and $R_{14}''$ each represents an alkyl group substituted with a sulfo or carboxyl group, a sulfo group, or an aryl group substituted with a sulfo or carboxyl group, or a sodium or potassium salt thereof; L represents a substituted or unsubstituted methine group; M represents a hydrogen atom, a sodium atom, or a potassium atom; l represents 0 or 1, and the compounds represented by formula (D-4):

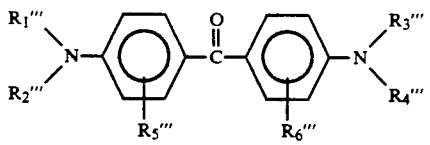

(D-4)

wherein $R_1'''$, $R_2'''$, and $R_4'''$ each represents an unsubstituted alkyl group, a hydroxyalkyl group, a cyano group, a cyanoalkyl group, an alkoxyl group, or a sulfoalkyl group; and $R_5'''$ and $R_6'''$ each represents a sulfo group or a sulfoalkyl group.

8. A negatively working silver halide photographic material as claimed in claim 6, wherein the heterocyclic ring formed by $Z^{21}$ or $Z^{22}$ in formula (II) is a benzoxazole nucleus or a benzothiazole nucleus.

9. A negatively corking silver halide photographic material as claimed in claim 6, wherein the dye having an absorption maximum at a wavelength between 300 to 420 nm is selected from the group consisting of a benzotriazole compound substituted with an aryl group, a 4-thiazolidone compound, a benzophenone compound, a cinnamic ester compound, a butadiene compound, a benzoxazole compound, and an ultraviolet absorbing polymer.

* * * * *